US009758984B2

(12) United States Patent
Yoshino et al.

(10) Patent No.: US 9,758,984 B2
(45) Date of Patent: Sep. 12, 2017

(54) AGGREGATE STACK DEMOLISHING SCAFFOLD APPARATUS AND METHOD FOR DEMOLISHING AGGREGATE STACK USING THE APPARATUS

(71) Applicant: BESTERRA CO., LTD., Tokyo (JP)

(72) Inventors: Yoshihide Yoshino, Tokyo (JP); Yoshiaki Aoki, Tokyo (JP)

(73) Assignee: BESTERRA CO., LTD., Tokyo (JP)

( * ) Notice: Subject to any disclaimer, the term of this patent is extended or adjusted under 35 U.S.C. 154(b) by 174 days.

(21) Appl. No.: 14/441,456

(22) PCT Filed: Nov. 8, 2012

(86) PCT No.: PCT/JP2012/078930

§ 371 (c)(1),
(2) Date: May 7, 2015

(87) PCT Pub. No.: WO2014/073063

PCT Pub. Date: May 15, 2014

(65) Prior Publication Data

US 2015/0300039 A1 Oct. 22, 2015

(51) Int. Cl.
*E04H 12/34* (2006.01)
*E04G 3/24* (2006.01)
(Continued)

(52) U.S. Cl.
CPC ..... *E04H 12/348* (2013.01); *E04G 3/24* (2013.01); *E04G 3/246* (2013.01); *E04G 3/30* (2013.01);
(Continued)

(58) Field of Classification Search
CPC .... E04G 3/00; E04G 3/20; E04G 3/24; E04G 3/243; E04G 3/246; E04G 3/28;
(Continued)

(56) References Cited

U.S. PATENT DOCUMENTS 3,761,551 A 9/1973 Ogata et al.
4,955,457 A 9/1990 Pohl et al.
(Continued)

FOREIGN PATENT DOCUMENTS

CN 101109233 A 1/2008
DE 3635597 A1 4/1988
(Continued)

*Primary Examiner* — Christopher Besler
*Assistant Examiner* — Matthew P Travers
(74) *Attorney, Agent, or Firm* — Birch, Stewart, Kolasch & Birch, LLP

(57) ABSTRACT

A demolishing method utilizes an aggregate stack demolishing scaffold apparatus mounted to an upper part of an aggregate stack including four smoke funnels arranged adjacent to each other. An uneven scaffold including one plate-shaped upper scaffold portion is placed on an upper end of each smoke funnel. A lower scaffold portion is coupled to the upper scaffold portion and located in lower positions in the smoke funnels with the upper scaffold portion being placed on the upper ends of the smoke funnels. A chain block suspends and supports the uneven scaffold from and on an inner wall of each smoke funnel, and adjusts a suspending height. With this configuration, the upper scaffold portion is located on the upper ends of the smoke funnels, and thus there is no possibility of contact between the scaffolds in the smoke funnels causing a worker to lose his balance, thereby improving safety.

4 Claims, 14 Drawing Sheets

(51) Int. Cl.

| | |
|---|---|
| ***E04G 3/30*** | (2006.01) |
| ***E04G 23/08*** | (2006.01) |
| *E04H 12/28* | (2006.01) |

(52) U.S. Cl.
CPC ..... *E04G 23/08* (2013.01); *E04G 2023/087* (2013.01); *E04H 12/28* (2013.01); *Y10T 29/49821* (2015.01)

(58) Field of Classification Search
CPC ..... E04G 2003/283; E04G 2003/286; E04G 3/30; E04G 3/305; E04G 2005/008; E04G 2023/087; E04H 2012/006; E04H 12/28; E04H 12/348; B23P 19/04; Y10T 29/49815; Y10T 29/49821
USPC ..... 182/128, 142, 150
See application file for complete search history.

(56) References Cited

U.S. PATENT DOCUMENTS

| | | | | |
|---|---|---|---|---|
| 5,971,136 | A | 10/1999 | Takeda | |
| 8,302,736 | B1 * | 11/2012 | Olivier | E21B 15/00 166/379 |
| 2016/0069099 | A1 * | 3/2016 | Ohlen | B66B 9/187 52/123.1 |

FOREIGN PATENT DOCUMENTS

| | | | | |
|---|---|---|---|---|
| DE | 298 12 795 | U1 | 12/1998 | |
| DE | 102011003164 | * | 7/2012 | B66B 9/187 |
| EP | 0 370 280 | A1 | 5/1990 | |
| FR | 2099309 | A5 | 3/1972 | |
| JP | 3452816 | B2 | 10/2003 | |
| JP | 2004-76256 | A | 3/2004 | |
| JP | 4001332 | B2 | 10/2007 | |
| WO | WO 00/04255 | A1 | 1/2000 | |

* cited by examiner

AGGREGATE STACK DEMOLISHING SCAFFOLD APPARATUS AND METHOD FOR DEMOLISHING AGGREGATE STACK USING THE APPARATUS

TECHNICAL FIELD

The present invention relates to an aggregate stack demolishing scaffold apparatus for demolishing an aggregate stack including a plurality of smoke funnels collectively arranged in one location from an upper part thereof, and a method for demolishing an aggregate stack using the apparatus.

BACKGROUND ART

Conventionally, for demolishing a very tall smokestack, a crane or a tower crane from the ground is used to build a temporary scaffold from the ground to a top of the smokestack using steel pipes, plate materials, or the like, then workers go up onto the scaffold, and demolish the smokestack by chipping, or demolish a metal smokestack by gas cutting, from an upper end thereof. However, building and demolishing such a temporary scaffold for a tall smokestack requires much labor. Also, the entire temporary scaffold needs to be firmly built, which increases a time for the entire smokestack demolishing work and thus increases cost for the work. Further, since demolishing the temporary scaffold also requires a crane, using the crane in a work period increases cost.

Thus, Patent Literature 1 discloses a smokestack demolishing scaffold apparatus that eliminates the need for building a tall temporary scaffold, and thus eliminates the need for continuously using a crane or a tower crane as described above, and a method for demolishing a smokestack using the scaffold apparatus. FIG. 12 illustrates demolishing of a smokestack using the smokestack demolishing scaffold apparatus. As shown in FIG. 12(*a*), a smokestack demolishing scaffold apparatus 100 includes, at a circular upper end of an inner cylinder 120 of a smokestack having a double cylinder structure constituted by the inner cylinder 120 and an outer cylinder 122, a scaffold frame 108 including a doughnut-shaped upper floor 102 placed to cover the upper end, and a substantially circular lower floor 106 supported by a column 104 extending downward from the upper floor 102 into the inner cylinder 120 and mounted in the inner cylinder 120. A method for demolishing a smokestack using the smokestack demolishing scaffold apparatus 100 will be described below.

First, as shown in FIG. 12(*a*), (i) the upper floor 102 is placed on the upper end of the inner cylinder 120 of the smokestack having the double cylinder structure, and the smokestack demolishing scaffold apparatus 100 is locked with the lower floor 106 being mounted in the inner cylinder 120. Then, (ii) one end of a chain 110 having the other end secured to the column 104 is mounted to an inner wall of the inner cylinder 120 to support the scaffold frame 108 on the inner wall of the inner cylinder 120. (iii) In this state, a worker moves onto the upper floor 102 to cut and remove a portion of a predetermined height 122*a* from the upper end of the outer cylinder 122 (see FIG. 12(*a*)). (iv) Then, a compact tractor (not shown) having the chain 110 is operated to wind up the chain 110 to slightly raise the scaffold frame 108 so that the upper floor 102 is slightly spaced upward from the upper end of the inner cylinder 120. Then, (v) in that state, as shown in FIG. 12(*b*), a portion of a predetermined height 120*a* from the upper end of the inner cylinder 120 is horizontally cut and removed. After the portion of a predetermined height 120*a* of the inner cylinder 120 is cut, the worker then (vi)) operates the compact tractor to unwind the chain 110 to lower the scaffold frame 108, and as shown in FIG. 12(*c*), locks the upper floor 102 to a new upper end of the inner cylinder 120. Then, after a mounting position of the other end of the chain 110 to the inner wall of the inner cylinder 120 is changed to a lower position, steps in (iii) to (vi) are repeated. Thus, the worker can successively demolish the smokestack from the upper end thereof while moving down.

Thus, the smokestack demolishing scaffold apparatus 100 eliminates conventional building and demolishing works of a tall temporary scaffold, thereby allowing a tall smokestack to be easily demolished at low cost.

PRIOR ART LITERATURE

Patent Literature

Patent Literature 1: Japanese Patent No. 4001332

SUMMARY OF INVENTION

Problems to be Solved by the Invention

As described above, the smokestack demolishing scaffold apparatus 100 in Patent Literature 1 is effective for demolishing one tall smokestack having a double cylinder structure.

As shown in FIG. 13, in a thermal power plant or the like, an aggregate stack is used in which two or more smoke funnels each having a single cylinder structure (corresponding to the inner cylinder in Patent Literature 1) are collectively arranged adjacent to each other as one unit, and surrounded and supported by a steel tower. In FIG. 13, four smoke funnels are surrounded and supported by a steel tower. For collectively demolishing the smoke funnels in the aggregate stack using the conventional smokestack demolishing scaffold apparatus, the smokestack demolishing scaffold apparatus 100 is applied to each smoke funnel to perform a demolishing work. However, in this case, upper floors 102 placed on upper ends of the adjacent smoke funnels come into contact with each other, the contact may vertically moves scaffold frames 108, and a worker working in a high place may dangerously lose his balance.

Also, if an area of the upper floor 102 is reduced to avoid the contact between the upper floors 102, it is difficult to ensure a scaffold sufficient for the worker working in the high place to cut an outer column 134 of the steel tower, which is also dangerous.

The present invention is achieved in view of the above problems, and has an object to provide a smokestack demolishing scaffold apparatus capable of easily demolishing even an aggregate stack with safety and efficiency at low cost, and a demolishing method using the apparatus.

Means for Solving the Problems

To achieve the object, the invention according to claim 1 provides an aggregate stack demolishing scaffold apparatus to be mounted to an aggregate stack including a plurality of smoke funnels arranged adjacent to each other, for demolishing the aggregate stack from an upper part, comprising: an uneven scaffold including at least one upper scaffold portion that can be placed on upper ends of the smoke funnels, and configured to be simultaneously vertically movable, and lower scaffold portions coupled to the upper scaffold portion, and located in lower positions in the smoke funnels with the upper scaffold portion being placed on the upper ends of the smoke funnels; and suspending means capable of joining a part lower than the upper scaffold portion in the uneven scaffold with an inner wall of each smoke funnel to suspend and support the uneven scaffold from and on the inner wall, and adjusting a suspending height, with the upper scaffold portion is spaced apart from the upper ends of the smoke funnels.

With this configuration, the upper scaffold portion is placed on the upper ends of the smoke funnels, and the uneven scaffold is supported on the inner wall of the smoke funnel by the suspending means, thereby allowing a demolishing work of the aggregate stack from top to bottom. Thus, there is no need to build a temporary scaffold up to an upper end of a tall aggregate stack, which is economical.

In the demolishing work, the upper scaffold portions placed on the upper ends of the smoke funnels are simultaneously vertically movable. Thus, for example, when the suspending means is used to vertically change a height of the uneven scaffold, there is no possibility that the upper scaffold portions are separately vertically moved to come into contact with each other, thereby avoiding a possibility that a worker loses his balance due to vibration caused by the contact. A large area of the entire upper scaffold portions may be obtained without worrying about the contact between the upper scaffold portions. Thus, for example, for an aggregate stack including a support steel tower, a scaffold area sufficient for demolishing the support steel tower can be ensured, thereby increasing safety in the work.

In the invention according to claim 2, the uneven scaffold is separately configured as separate structures, each of which corresponding to one of the smoke funnels to be demolished, and mounted to a support located above, and the separate structures are mounted to the support so as to be horizontally movable apart from each other in the aggregate stack demolishing scaffold apparatus according to claim 1.

With this configuration, even for a self-supported aggregate stack in which a distance between smoke funnels gradually increases from top to bottom in a flared manner, the separate structures are horizontally moved apart from each other in the process of a demolishing work from top to bottom of the smokestacks, and thus a distance between the lower scaffold portions can be matched with the gradually increasing distance between the smoke funnels to advance the demolishing work of the aggregate stack.

Directions apart from each other mean directions of a plurality of objects being moving apart from each other. For example, for demolishing a self-supported aggregate stack including four smoke funnels arranged in a flared manner, four separate structures constituting uneven scaffold are radially horizontally moved apart from each other so as to match gradually increasing distances between the four smoke funnels.

In the invention according to claim 3, the support includes a first beam member extending in one direction, and a second beam member extending perpendicularly to the first beam member, and supported by the first beam member so as to be movable in an extending direction of the first beam member, and the structures constituting the uneven scaffold are mounted to the second beam member so as to be movable in an extending direction of the second beam member in the aggregate stack demolishing scaffold apparatus according to claim 2.

With this configuration, the second beam member is movable in one direction that is the extending direction of the first beam member, and the structures of the uneven scaffold are movable perpendicularly to the first beam member that is the extending direction of the second beam member. Thus, the structures are horizontally movable in longitudinal, lateral, and oblique directions from its original position via the support.

Thus, whichever direction of the longitudinal, lateral, and oblique directions the smoke funnels are moved apart from top to bottom, the structures constituting the uneven scaffold can be horizontally moved in the directions apart from each other, and the lower scaffold portions can be aligned with the upper ends of the smoke funnels.

In the invention according to claim 4, the support is a substantially cross-shaped beam member, and the separate structures are mounted between a center and four ends of the beam member so as to be reciprocable between the center and the ends of the beam member in the aggregate stack demolishing scaffold apparatus according to claim 2.

This invention specifically shows an example of a configuration of the support in claim 2. With this configuration, the four separate structures constituting the uneven scaffold mounted to the substantially cross-shaped beam member are radially horizontally movable from the center to the ends of the substantially cross-shaped beam member.

Thus, for demolishing an aggregate stack in which four smoke funnels arranged to have a substantially rectangular shape on plan view are combined so as to be radially spaced apart from each other from a center of the rectangular shape from top to bottom as often seen in a thermal power plant, the lower scaffold portions can be aligned with new upper ends having been spaced apart by a simple operation of moving the separate structures from the center to the ends of the beam member.

The invention according to claim 5 provides a method for demolishing an aggregate stack in which a plurality of smoke funnels substantially vertically stand using an aggregate stack demolishing scaffold apparatus according to claim 1, wherein the uneven scaffold is an integral-type scaffold coupled by one upper scaffold portion integrally formed, and the method comprises: an upper scaffold portion placing step of lowering the uneven scaffold from an upper part of the aggregate stack to insert the lower scaffold portion into each smoke funnel, and place the upper scaffold portion to span an upper end of each smoke funnel; an uneven scaffold supporting step of joining a part lower than the upper scaffold portion in the uneven scaffold with an inner wall of at least one smoke funnel among the plurality of smoke funnels at a height higher than the lower part using the suspending means, and adjusting a suspending length of the suspending means to apply tension to such an extent that the upper scaffold portion remains without being spaced apart from the upper end of each smoke funnel; a smoke funnel cutting and removing step of cutting and removing each smoke funnel from the upper end of each smoke funnel to a height near a mounting position of the suspending means to the inner wall of the smoke funnel; an upper scaffold portion replacing step of lowering the uneven scaffold using the suspending means, and placing the upper scaffold portion on a new upper end of each smoke funnel; and a repeating step of repeating from the uneven scaffold supporting step to the upper scaffold portion replacing step.

This invention shows an example of the method for demolishing an aggregate stack using the aggregate stack demolishing scaffold apparatus according to claim 1, and particularly provides a method for demolishing an aggregate stack in which the plurality of smoke funnels substantially vertically stand using the smokestack demolishing scaffold apparatus including the integral-type uneven scaffold having the integrally formed upper scaffold portion.

With this configuration, the upper scaffold portion placing step and the steps thereafter can be performed to advance the demolishing work of the aggregate stack from top to bottom of each smoke funnel. Thus, there is no need to build a tall temporary scaffold up to the upper end of the aggregate stack, which is economical.

Also, since the upper scaffold portion is integrally formed, there is no possibility that the upper scaffold portions come into contact with each other in the demolishing work, thereby allowing the demolishing work to be safely advanced without vibration due to the contact. A large area of the upper scaffold portion may be obtained without worrying about the contact, thereby providing a scaffold apparatus with improved safety.

Further, the suspending means joins the inner wall of at least one smoke funnel among the plurality of smoke funnels with the uneven scaffold to adjust the suspending length, thereby finishing the uneven scaffold supporting step. Also, only the suspending means mounted to the smoke funnel is operated to finish the upper scaffold portion replacing step. This significantly increases speed and efficiency of the smokestack demolishing work, which is economical.

The invention according to claim 6 provides a method for demolishing an aggregate stack including an upper region in which a plurality of smoke funnels substantially vertically stand, and a lower region in which the plurality of smoke funnels are gradually spaced apart from each other from top to bottom below the upper region using an aggregate stack demolishing scaffold apparatus according to any one of claims 2 to 4, wherein the method comprises: an upper region demolishing work including an upper scaffold portion placing step of lowering the uneven scaffold, which configured as separate structures, together with a support from an upper part of the aggregate stack, inserting a lower scaffold portion into each smoke funnel, and placing a respective upper scaffold portion on an upper end of each smoke funnel, an uneven scaffold supporting step of joining a part lower than the upper scaffold portion in the uneven scaffold with an inner wall of at least one smoke funnel among the plurality of smoke funnels at a height higher than the lower part using the suspending means, and adjusting a suspending length of the suspending means to apply tension to such an extent that the upper scaffold portion remains without being spaced apart upward from the upper end of each smoke funnel, a smoke funnel cutting and removing step of cutting and removing each smoke funnel from the upper end of each smoke funnel to a height near a mounting part of the suspending means to the inner wall of the smoke funnel, an upper scaffold portion replacing step of lowering the uneven scaffold joined to the inner wall of the at least one smoke funnel using the suspending means, and placing all the upper scaffold portions on new upper ends of the smoke funnels, and a repeating step of repeating from the uneven scaffold supporting step to the upper scaffold portion replacing step up to a lower end of the upper region; and a lower region demolishing work including the uneven scaffold as the separate structures horizontally moving step of horizontally moving the separate structures apart from each other in accordance with an increased distance between the smoke funnels, and matching a distance between the lower scaffold portions inserted into the smoke funnels with the increased distance between the smoke funnels, with the upper scaffold portion being placed on the upper end of each smoke funnel in the lower region after the upper region demolishing work is finished, an uneven scaffold as the separate stuructures re-supporting step of changing a mounting part of the suspending means to an inner wall of the at least one smoke funnel to a part lower than an original mounting part and at a height higher than the mounting part of the suspending means to the uneven scaffold, and adjusting a suspending length of the suspending means to apply tension to such an extent that the upper scaffold portion is not spaced apart upward from the upper end of each smokestack, a smoke funnel cutting and removing step of cutting and removing each smoke funnel from the upper end of each smoke funnel to a height near the mounting part of the suspending means to the inner wall of the smoke funnel, an upper scaffold portion replacing step of lowering the uneven scaffold joined to the inner wall of the at 1 east one smoke funnel using the suspending means, and placing all the upper scaffold portions on new upper ends of the smoke funnels; and a repeating step of repeating from the uneven scaffold horizontally moving step to the upper scaffold portion replacing step.

This invention shows an example of the method for demolishing an aggregate stack using the smokestack demolishing scaffold apparatus according to any one of claims 2 to 4, and particularly provides a method for demolishing an aggregate stack in which a distance between the smoke funnels gradually increases from top to bottom on the lower side using the smokestack demolishing scaffold apparatus including a separation-type uneven scaffold in which the uneven scaffolds are separately configured for each smoke funnel.

With this configuration, in the upper region, the aggregate stack demolishing work can be performed successively from top by the upper region demolishing work. Further, in the lower region, the uneven scaffolds can be horizontally moved apart from each other by the uneven scaffold as separate structures horizontally moving step, and thus the distance between the lower scaffold portions can be matched with the distance between the smoke funnels gradually spaced apart from each other from top to bottom to advance the aggregate stack demolishing work. Thus, even for a "flared" aggregate stack in which the distance between the smoke funnels gradually increases from top to bottom on the lower side, the demolishing work can be performed without building a temporary scaffold, which is economical.

Further, the suspending means joins the inner wall of at least one smoke funnel among the plurality of smoke funnels with the uneven scaffold to adjust the suspending length, thereby finishing the uneven scaffold supporting step. Also, only the suspending means mounted to the smoke funnel is operated to also finish the upper scaffold portion replacing step. This significantly increases speed and efficiency of the smokestack demolishing work, which is further economical.

Also, since the upper scaffold portions are vertically movable together with the support, there is no possibility that the upper scaffold portions having been separately vertically moved come into contact with each other, thereby allowing the demolishing work to be safely advanced without vibration due to the contact, and providing a scaffold apparatus with improved safety.

Effects of Invention

According to the present invention, a tall aggregate stack can be demolished economically without building a temporary scaffold up to an upper end of the aggregate stack, and also there is no possibility that a contact between upper scaffold portions vertically moves the entire uneven scaffolds causing a worker to lose his balance, thereby allowing the aggregate stack demolishing work to be safely advanced.

Similarly, a large area of the upper scaffold portion may be obtained without worrying about the contact between the upper scaffold portions, thereby ensuring a sufficiently broad scaffold and further improving safety in the work.

MODE FOR CARRYING OUT THE INVENTION

Next, with reference the drawings, embodiments of the present invention will be described in detail.

First Embodiment

Figure 13:
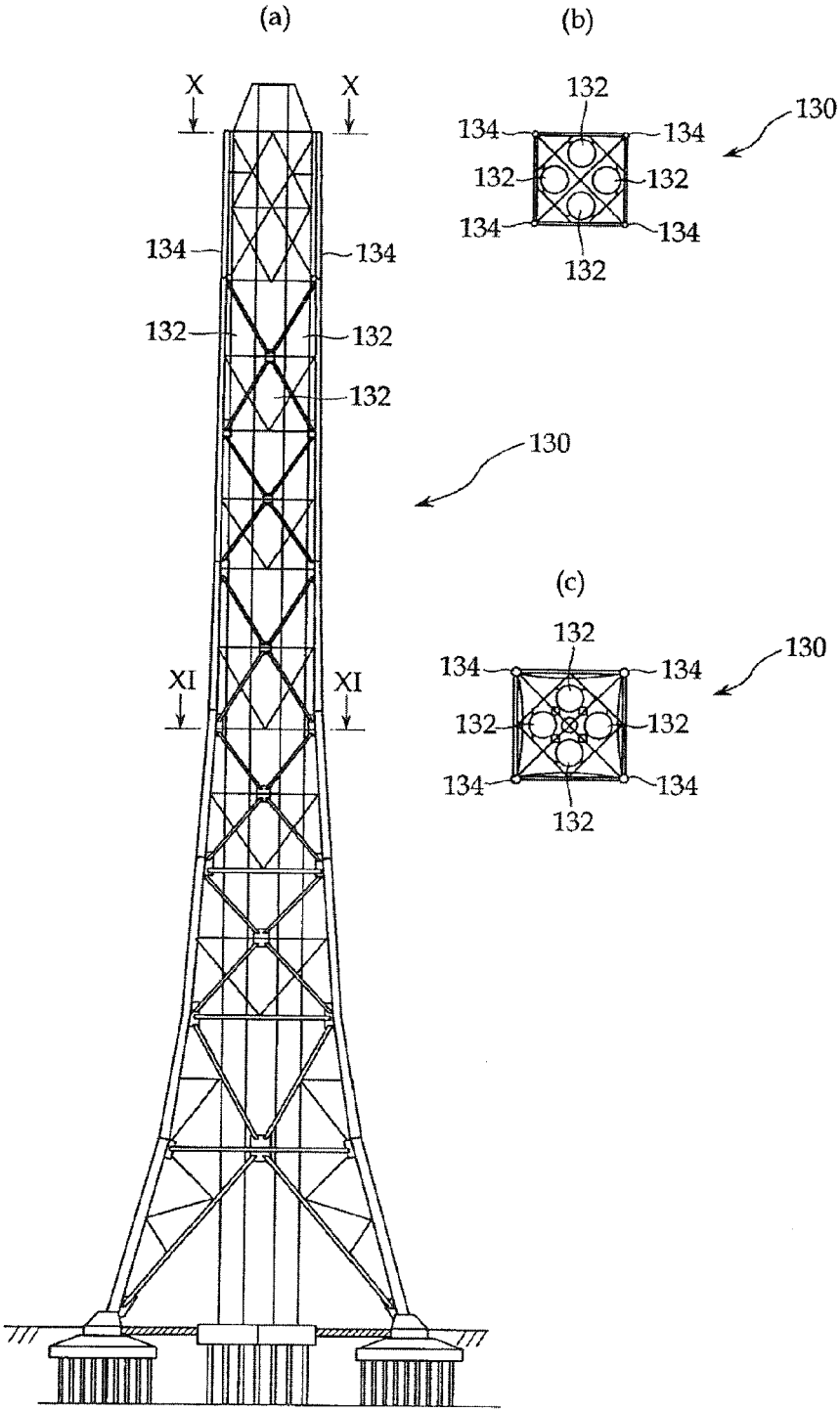
FIG. 13 illustrates an aggregate stack supported by a support steel tower.

With reference to FIGS. 1 to 7, a first embodiment of a smokestack demolishing scaffold apparatus (that is, an aggregate stack demolishing scaffold apparatus) according to the present invention will be described when used for an aggregate stack 130 in which four smoke funnels 132 substantially vertically standing and each having a single cylinder structure are collectively arranged, and surrounded and supported by a steel tower 134 as shown in FIG. 13 as an example.

Figure 1:
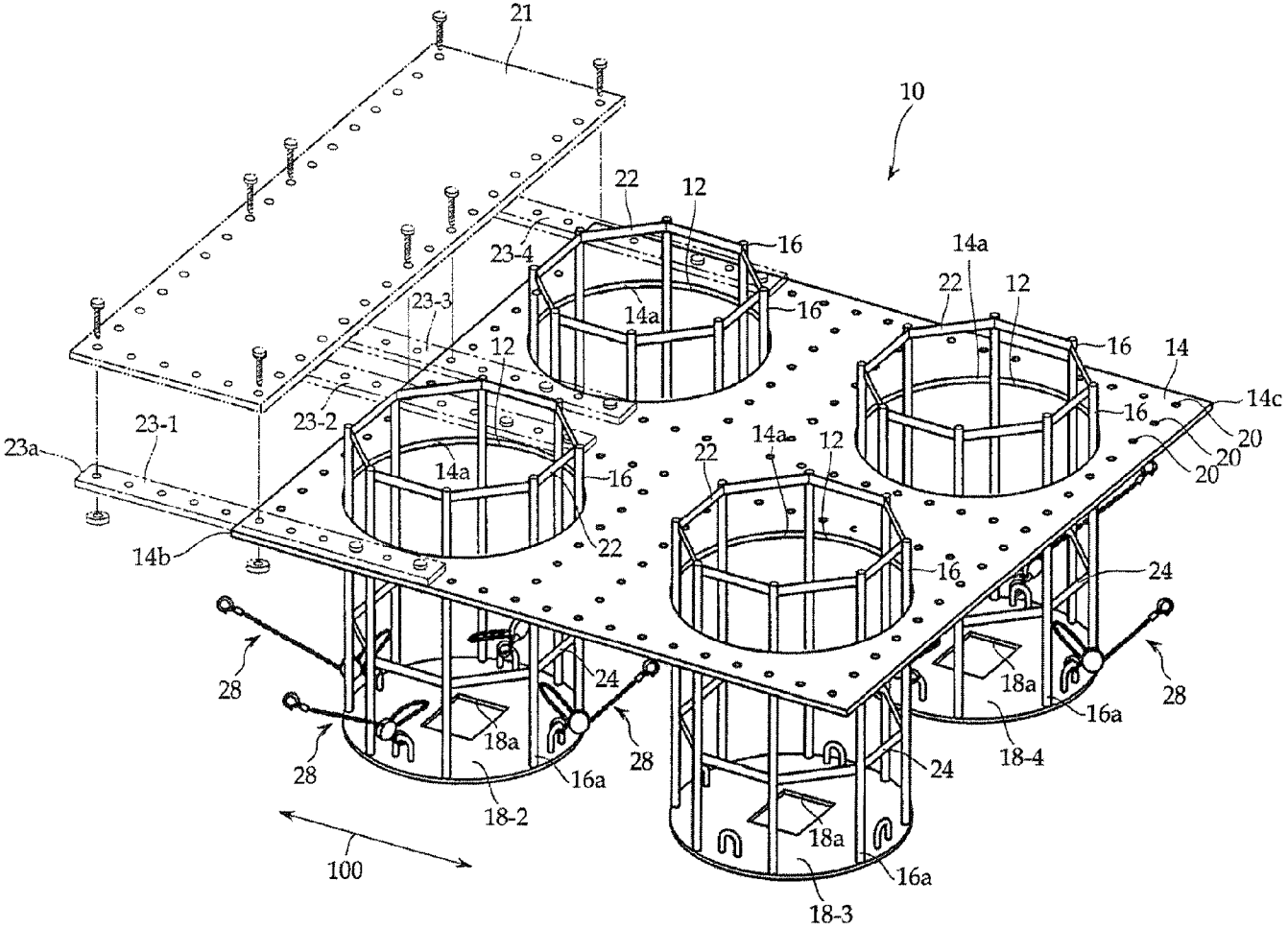
FIG. 1 is a schematic perspective view of a smokestack demolishing scaffold apparatus 10 according to a first embodiment of the present invention.
Figure 2:
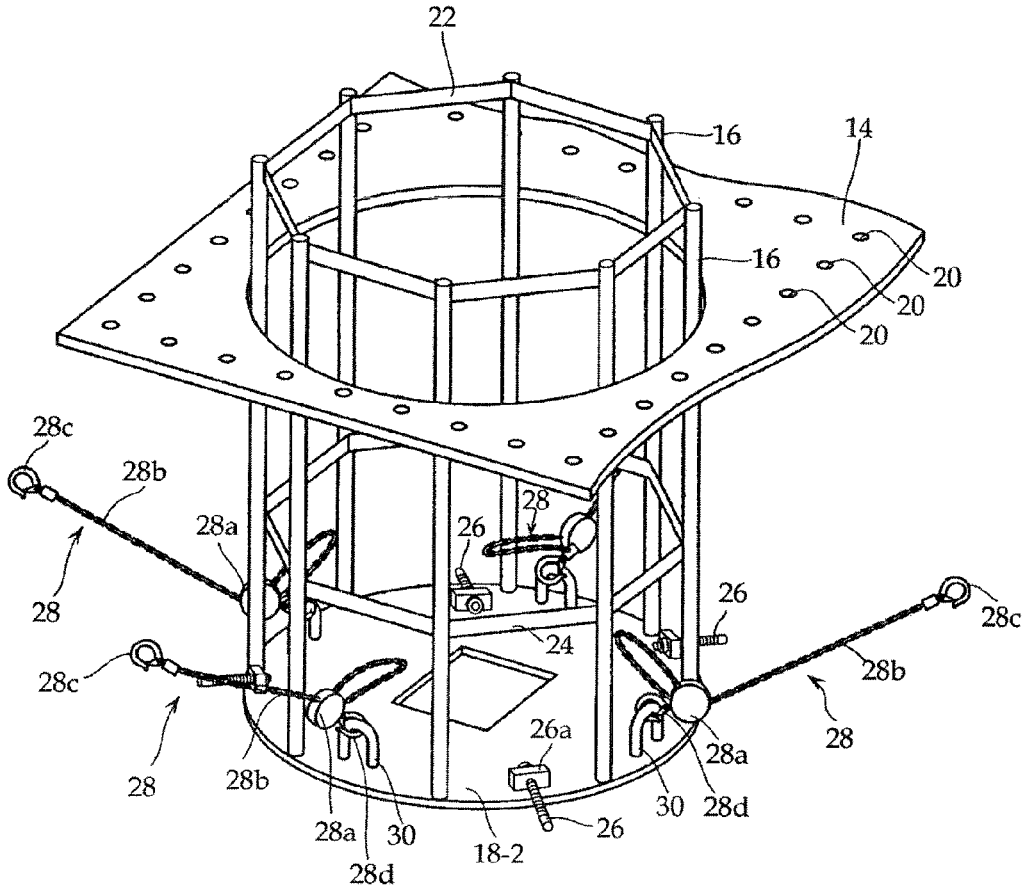
FIG. 2 is an enlarged perspective view for illustrating essential portions of the smokestack demolishing scaffold apparatus 10 according to the first embodiment of the present invention.
Figure 3:
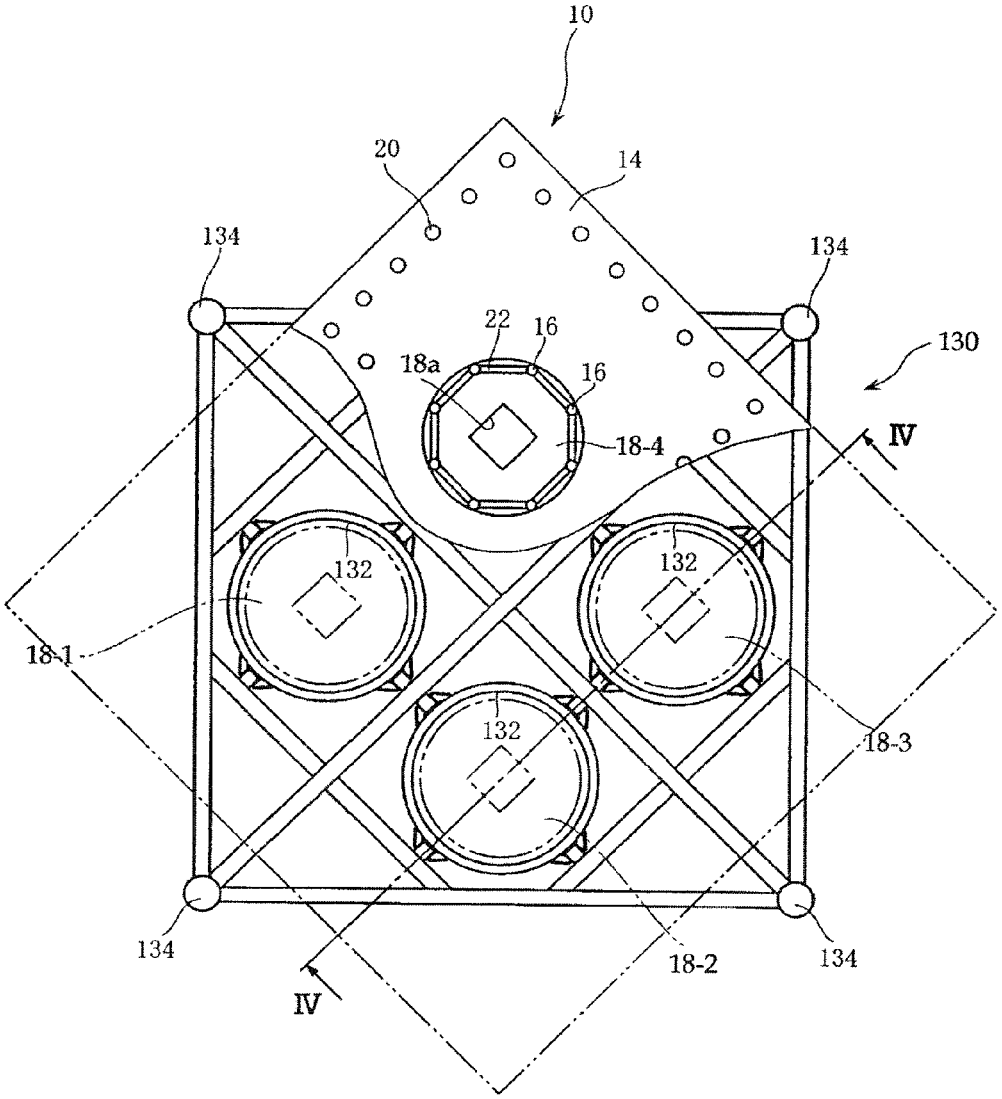
FIG. 3 is a schematic plan view showing the smokestack demolishing scaffold apparatus 10 being placed on upper ends of smoke funnels of an aggregate stack according to the first embodiment of the present invention.
Figure 4:
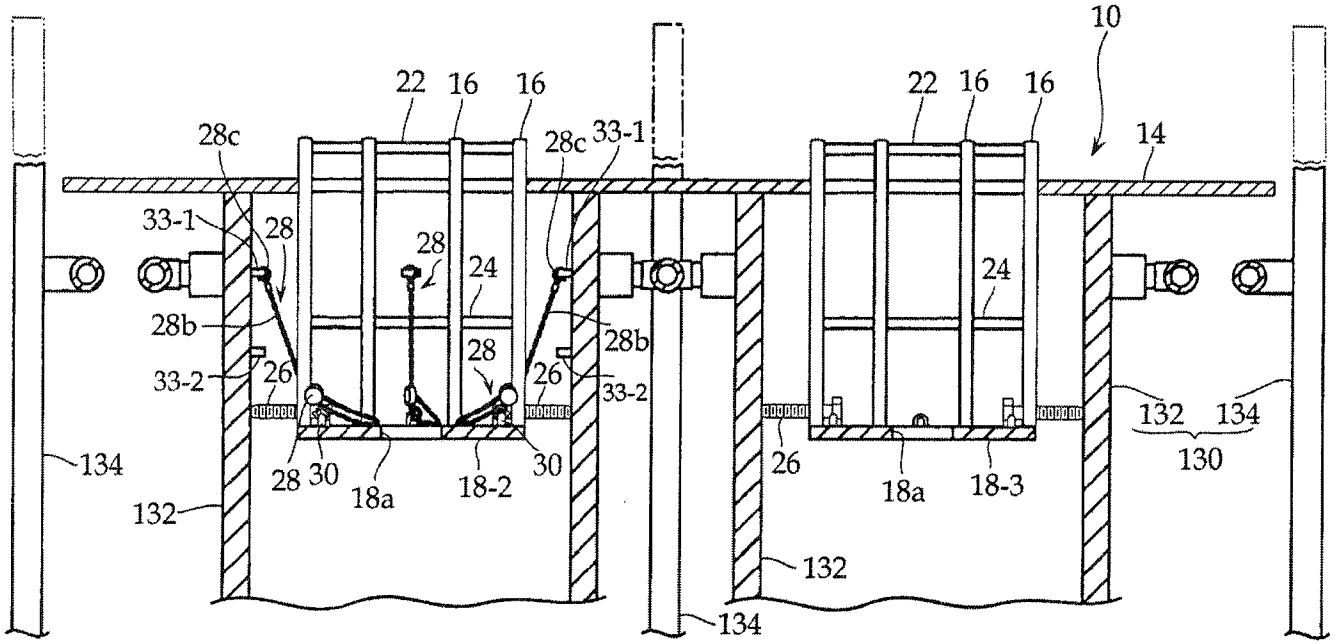
FIG. 4 is a sectional view taken along the line IV-Iv in FIG. 3 according to the first embodiment of the present invention.
Figure 5:
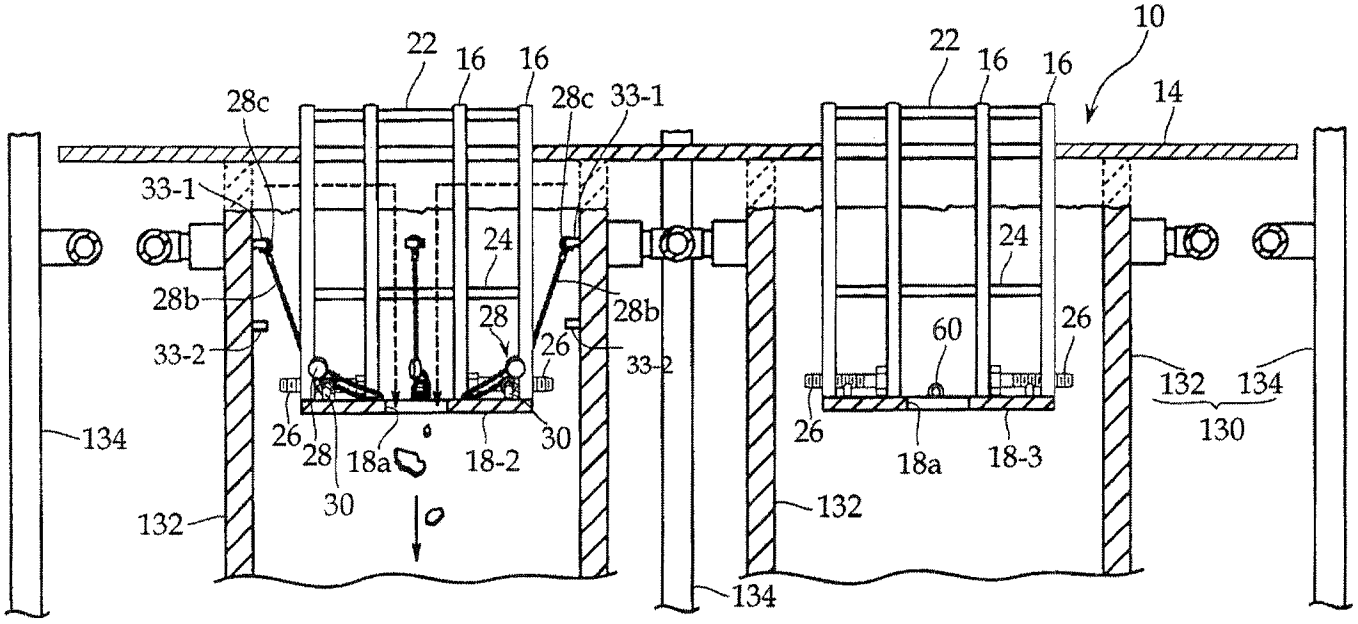
FIG. 5 illustrates an aggregate stack demolishing method (a smoke funnel cutting and removing step) using the smokestack demolishing scaffold apparatus 10 according to the first embodiment of the present invention.
Figure 6:
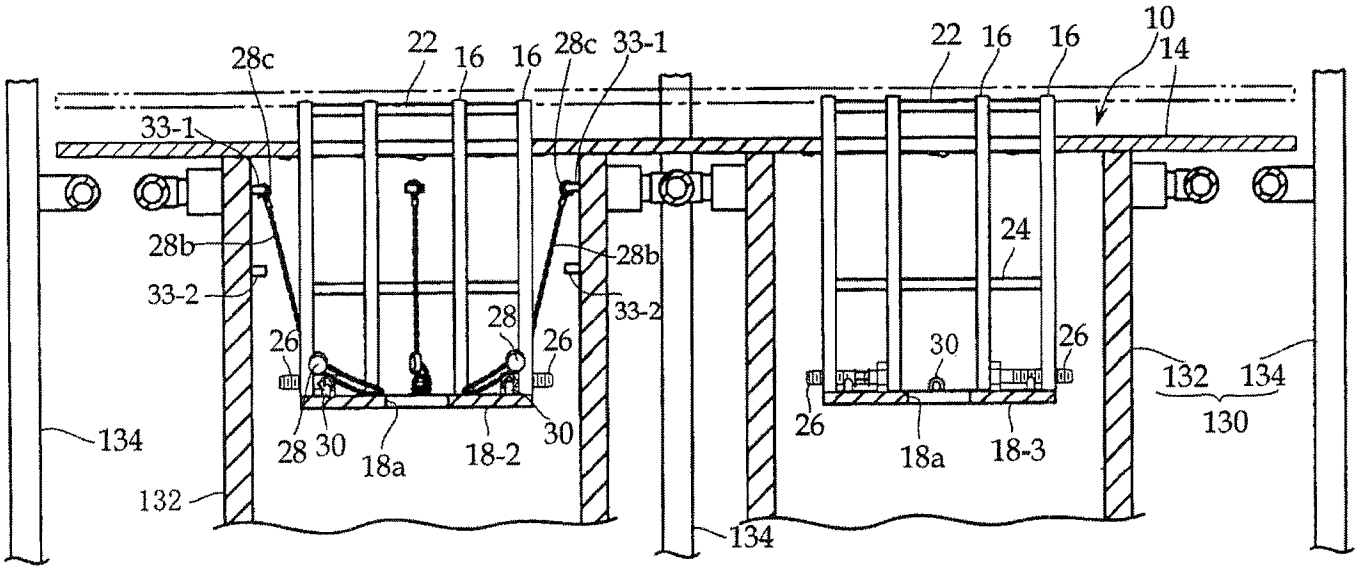
FIG. 6 illustrates an aggregate stack demolishing method (an upper scaffold portion replacing step) using the smokestack demolishing scaffold apparatus 10 according to the first embodiment of the present invention.
Figure 7:
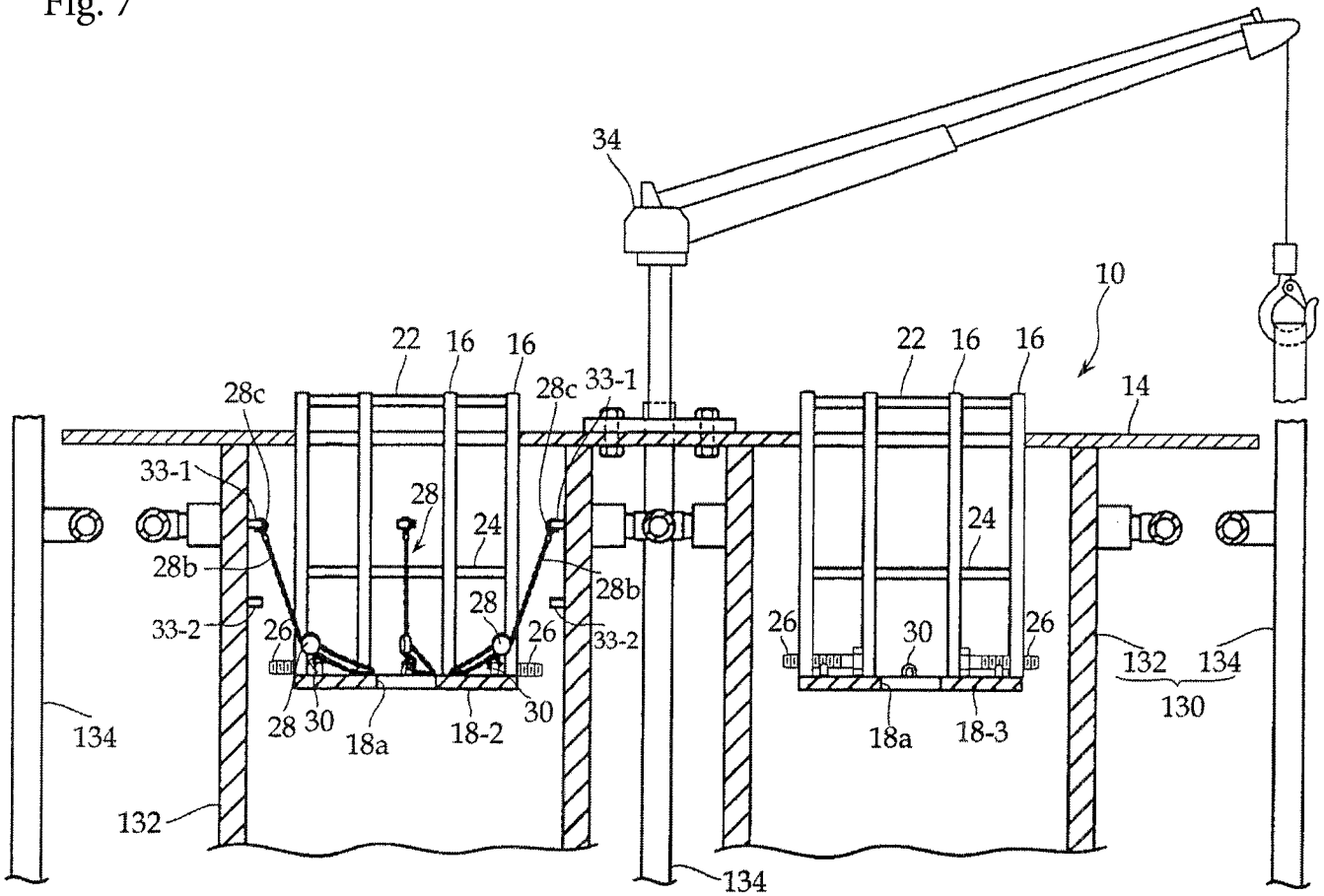
FIG. 7 shows a variant of the smokestack demolishing scaffold apparatus 10 according to the first embodiment of the present invention.

FIG. 1 is a schematic perspective view of a smokestack demolishing scaffold apparatus 10 according to a first embodiment of the present invention, FIG. 2 is an enlarged perspective view for illustrating essential portions of the smokestack demolishing scaffold apparatus 10 according to this embodiment. FIG. 3 is a schematic plan view showing the smokestack demolishing scaffold apparatus 10 according to this embodiment being placed on upper ends of smoke funnels 132 of the aggregate stack 130, FIG. 4 is a sectional view taken along the line IV-IV in FIG. 3, FIG. 5 illustrates an aggregate stack demolishing method (a smoke funnel cutting and removing step) using the smokestack demolishing scaffold apparatus 10 according to this embodiment, FIG. 6 illustrates an aggregate stack demolishing method (an upper scaffold portion replacing step) using the smokestack demolishing scaffold apparatus 10 according to this embodiment, and FIG. 7 shows a variant of the smokestack demolishing scaffold apparatus 10 according to this embodiment.

FIG. 13(*a*) illustrates the aggregate stack 130 supported by the support steel tower 134, FIG. 13(*b*) is a sectional view taken along the line X-X in FIG. 13(*a*), and FIG. 13(*c*) is a sectional view taken along the line XI-XI in FIG. 13(*a*).

As shown in FIG. 1, the smokestack demolishing scaffold apparatus 10 has a basic configuration in which lower scaffold portions 18 (18-1, 18-2, 18-3 and 18-4) each formed of a circular plate material are secured to lower ends 16*a* of eight column members 16 secured to hole edges 14*a* of an upper scaffold portion 14, the upper scaffold portion 14 being integrally formed as one substantially rectangular plate having four through holes 12.

The upper scaffold portion 14 has the four through holes 12, and also many small holes 20 arranged at predetermined intervals in longitudinal and lateral directions. The small holes 20 are used, for example, for mounting a plate material 21 for enlarging an area of the upper scaffold portion 14 to the upper scaffold portion 14 in a case where there is a large distance between steel towers surrounding and supporting the smoke funnels, and the area of the upper scaffold portion 14 needs to be enlarged in demolishing the steel towers. A specific aspect of mounting of the plate material 21 will be described later. Also, the small holes 20 reduce swinging or the like caused by wind blowing on the upper scaffold portion 14 placed on the upper end of the aggregate stack 130 in a high place (see FIG. 13(*a*)).

A position and a size of the through hole 12 in the upper scaffold portion 14 are set so that the lower scaffold portions 18 coupled to the upper scaffold portion 14 by the column members 16 secured to the hole edges 14*a* can be inserted into the four smoke funnels 132 in the aggregate stack 130.

The column member 16 is a rod member extending perpendicularly to the upper scaffold portion 14, and eight column members 16 are arranged at regular intervals at each hole edge 14*a* of the through hole 12 in the upper scaffold portion 14 and secured to the hole edge 14*a*. Bridge members 22 and 24 horizontally coupling the eight column members 16 are provided on upper and lower sides of the upper scaffold portion 14. The bridge members 22, 24 provide stiffness of the apparatus, and prevent the worker from falling from the upper scaffold portion 14 and the lower scaffold portion 18.

The lower scaffold portion 18 is a circular plate material as described above, and secured to lower ends 16*a* of the eight column members. A substantially rectangular hole 18*a* is provided in a center of each lower scaffold portion 18.

As described later, the hole 18*a* is for dropping a cut piece of the smoke funnel 132 and a cut piece of the support steel tower 134 into the smoke funnel 132, and thus may have a size sufficient for the cut piece of the smoke funnel 132 or the like to pass through.

Also, as shown in FIG. 2, on the lower scaffold portion 18, rod-shaped protruding members 26 each having a front end that can protrude radially outward are provided at four locations near an edge of the lower scaffold portion 18 and in four directions of the lower scaffold portion 18. The protruding member 26 is, for example, a screw, which is threaded into a screw receiver 26*a* having a female thread, and is rotated to adjust a protruding length of the front end. The protruding member 26 constitutes securing means for securing the uneven scaffold to the smoke funnel 132 by the protruding front end being pressed against an inner wall of the smoke funnel 132.

Further, as shown in FIG. 2, U-shaped hooks 30 for mounting chain blocks 28 described later stand on four locations at regular intervals on an upper surface of the lower scaffold portion 18 so as to be arranged near the edge of the upper surface and in four directions of the lower scaffold portion 18. Between the lower scaffold portion 18 and the upper scaffold portion 14, a ladder (not shown) is provided for movement between the scaffold portions.

As such, in this embodiment, one upper scaffold portion 14 integrally formed, and the four lower scaffold portions 18 (18-1, 18-2, 18-3 and 18-4) coupled to the upper scaffold portion 14 by the column members 16 constitute the integral-type uneven scaffold. The upper scaffold portion 14 may be integrally formed by coupling a plurality of plate materials, for example, by rivet joining. This allows the plurality of plate materials to be separately carried to the upper end of the aggregate stack, and coupled at the upper end to assemble one upper scaffold portion 14.

Next, the chain block 28 will be described that is suspending means capable of joining the uneven scaffold with the inner wall of the smoke funnel 132, suspending and supporting the uneven scaffold from and on the inner wall, and adjusting a suspending height, with the upper scaffold portion 14 being not placed on the upper end of each smoke funnel 132.

As shown in FIG. 2, the chain block 28 includes a front end hook 28*c* mounted to a front end of the chain 28*b* wound and held in a body 28*a*, a base end hook 28*d* mounted to a base end of the chain 28*b* near the body 28*a*, and adjusting means (not shown) that is mounted to the body 28*a*, and makes adjustment by unwinding the chain 28*b* from the body 28*a* and winding up the chain 28*b*. The adjustment means may be any of a swing handle mounted to the body 28*a*, a hand chain, or an operation switch in using an electric chain block. In this embodiment, the swing handle mounted to the body 28*a* is used.

In this embodiment, as shown in FIG. 1, the base end hook 28*d* is hung on the U-shaped hook 30 on each of the lower scaffold portions 18-2 and 18-4 on a diagonal line connecting a corner 14*b* and a corner 14*c* of the upper scaffold portion 14, thereby mounting the chain block 28. Specifically, the chain block 28 is not mounted to the lower scaffold portions 18-1 and 18-3, and omitted.

A method for demolishing the aggregate stack 130 using the smokestack demolishing scaffold apparatus 10 according to this embodiment thus configured will be described below.

First, in the aggregate stack as shown in FIG. 13(*a*), four smoke funnels 132 are cut from an upper end of the aggregate stack by a predetermined method until a section in FIG. 13(*b*) appears. Then, with the section in FIG. 13(*b*) appearing, materials are hoisted through the smoke funnels 132 by a winch or the like to assemble the smokestack demolishing scaffold apparatus 10 (that is, the uneven scaffold) in an upper part of the smokestack. As shown in FIG. 3, the lower scaffold portions 18 (18-1, 18-2, 18-3 and 18-4) of the smokestack demolishing scaffold apparatus 10 thus assembled are inserted into the smoke funnels 132, and the upper scaffold portion 14 is placed to span the upper ends of the smoke funnels 132 (an upper scaffold portion placing step).

Then, as shown in FIG. 4, the front end hook 28*c* of the chain block 28 is hung and mounted on a first shackle 33-1 previously mounted to the inner wall of the smoke funnel 132 in a position higher than the U-shaped hook 30. Then, the swing handle (not shown) is operated to wind up the chain 28*b* to apply tension to the chain 28*b* to such an extent that the upper scaffold portion 14 is not spaced apart upward from the upper end of the smoke funnel 132. Thus, the uneven scaffold is supported on the inner walls of the two smoke funnels 132 filled with the lower scaffold portions 18-2 and 18-4 (an uneven scaffold supporting step).

At this time, the protruding member 26 is caused to protrude radially outward and pressed against the inner wall of the smoke funnel 132, and thus the uneven scaffold is secured to the smoke funnels 132 together with the lower scaffold portions 18 (18-1, 18-2, 18-3 and 18-4) (an uneven scaffold securing step). This step is not essential but is significant in that the scaffold is stabilized in a work for removing the support steel tower described later to further improve safety in the work.

After the lower scaffold portions 18 are secured, the worker moves from the lower scaffold portions 18 to the upper scaffold portion 14 using the ladder (not shown), and as shown in FIG. 4, the worker cuts and removes a portion of a predetermined height from the upper end of the support steel tower 134 (a support steel tower removing step). The support steel tower 134 is cut by gas cutting by the worker, and the cut piece is dropped down into the smoke funnel 132 through the hole 18*a* provided in the lower scaffold portion 18.

After the portion of the predetermined height of the support steel tower 134 is removed, the worker again moves to the lower scaffold portion 18, retracts the protruding member 26 radially inward, and releases securing of the lower scaffold portion 18 to the smoke funnel 132. Then, the swing handle of the chain block 28 is operated to further wind up the chain 28*b*, and thus the upper scaffold portion 14 is maintained at a height slightly apart upward from the upper end of each smoke funnel 132 (an uneven scaffold raising step).

This step may be also omitted. In this case, the following step is performed in a state where the upper scaffold portion 14 is placed on the upper end of each smoke funnel 132, tension is applied to the chain 28*b* to such an extent that the upper scaffold portion 14 is not spaced apart upward from the upper end of the smoke funnel 132, and the uneven scaffold is supported on the inner wall of the smoke funnel 132 by the chain block 28.

Then, as shown in FIG. 5, the upper end of each smoke funnel 132 slightly apart from the upper scaffold portion 14 (the upper end of each smoke funnel 132 in contact with the upper scaffold portion 14 when the uneven scaffold raising step is omitted) is cut and removed from the upper end of each smoke funnel to a height near the mounting position of the shackle 33-1. Thus, a new upper end of the smoke funnel 132 is formed at a height lower than that before cutting. The smoke funnel 132 is cut by gas cutting by the worker, and as shown in FIG. 5, the cut piece is dropped down into the smoke funnel 132 through the hole 18*a* (a smoke funnel cutting and removing step).

After the portion of the predetermined height of the smoke funnel 132 is cut and removed, as shown in FIG. 6, the swing handle (not shown) is operated to unwind the chain 28*b* to lower the uneven scaffold, and the upper scaffold portion 14 is replaced on the new upper end of each smoke funnel 132 (an upper scaffold portion replacing step).

Then, an uneven scaffold supporting step is performed of hanging and mounting the front end hook 28*c* on the second shackle 33-2 mounted to a part lower than the shackle 33-1 mounted to the inner wall of the smoke funnel 132 and a part at a height higher than the U-shaped hook 30 as the mounting part of the chain block 28 on the uneven scaffold, and then the steps up to the upper scaffold portion replacing step are repeated (a repeating step).

As described above, by the method for demolishing the aggregate stack 130 using the smokestack demolishing scaffold apparatus 10 according to this embodiment, the aggregate stack 130 is successively demolished from top to bottom.

As the demolishing work advances from top to bottom of the aggregate stack 130, as seen from a comparison between FIGS. 13(*b*) and 13(*c*), a distance between the support steel towers 134 increases in a flared manner, and a distance between the support steel tower 134 and the upper scaffold portion 14 thus increases to make it difficult to demolish the support steel tower 134. In this case, as shown by a broken line in FIG. 1, long plate members 23 (23-1, 23-2, 23-3, 23-4) each having a substantially rectangular section are placed on the upper scaffold portion 14 so that one ends 23*a* thereof overhang further laterally from the upper scaffold portion 14 on the small holes 20 continuing laterally (in a direction of arrow 100) of the upper scaffold portion 14, and the long plate members 23 placed thereon are secured to the upper scaffold portion 14 through the small holes 20 by bolts and nuts. Then, the plate material 21 is placed on the four long plate members 23 (23-1, 23-2, 23-3, 23-4) overhanging from the upper scaffold portion 14, and both members are secured by bolts and nuts. Thus, the upper scaffold portion 14 can be laterally extended to continue the demolishing work of the support steel tower 134. Here, extension of the upper scaffold portion 14 in the lateral direction (direction of arrow 100) has been described, but the upper scaffold portion 14 may be of course extended in the longitudinal direction.

Thus, with the smokestack demolishing scaffold apparatus 10 according to this embodiment, one upper scaffold portion 14 integrally formed is placed to span the upper ends of the four smoke funnels 132, the uneven scaffold is supported on the smoke funnels 132 by the chain blocks 28, and the demolishing work of the aggregate stack 130 can be performed from top to bottom. Thus, there is no need to build a temporary scaffold up to the upper end of the tall aggregate stack 130, which is economical.

Since the lower scaffold portions 18 (18-1, 18-2, 18-3 and 18-4) are coupled to the integrally formed upper scaffold portion 14 by the column members 16, there is no possibility that the scaffolds located on the upper ends of the smoke funnels 132 come into contact with each other as in the case where the smokestack demolishing scaffold apparatus according to a conventional technology is applied to the smoke funnels 132 in the aggregate stack 130. This avoids a possibility that the contact vertically moves the lower scaffold portions 18 (18-1, 18-2, 18-3 and 18-4), and the worker loses his balance.

Also, a large area of the upper scaffold portion 14 may be obtained without worrying about the contact between the scaffolds. This can ensure a sufficiently broad scaffold, and improve safety in the work.

Further, with this configuration, the worker can move between the upper parts of the four smoke funnels 132 adjacent to each other on the upper scaffold portion 14 as one plate member to perform the demolishing work of the smoke funnels 132. Thus, using the smokestack demolishing scaffold apparatus of the conventional technology requires a total of four persons: at least one person for demolishing each smoke funnel 132, while at least two persons corresponding to the lower scaffold portions 18-2 and 18-4 to which the chain blocks 28 are mounted can perform the demolishing work of the aggregate stack 130. This can reduce the number of persons for the work. Also, the aggregate stack demolishing scaffold apparatus 10 according to this embodiment can be assembled at the upper end of the aggregate stack using the materials hoisted through the smoke funnel 132 by a winch or the like provided in the upper part of the aggregate stack. Thus, there is no need to separately prepare a tower crane or the like to hoist the apparatus up to the upper end of the aggregate stack, which is economical.

By the method for demolishing the aggregate stack 130 using the smokestack demolishing scaffold apparatus 10 according to this embodiment, the uneven scaffold is supported by the chain blocks 28 on the inner walls of the two smoke funnels 132 on the diagonal line among the four smoke funnels 132, the swing handle is operated to wind up the chain 28*b* to suspend the uneven scaffold, thereby allowing the upper scaffold portion 14 to be supported at a height slightly apart upward from the four smoke funnels 132.

Even after the portion of the predetermined height from the upper end of each smoke funnel 132 is removed, the uneven scaffold supported on the inner walls of the two smoke funnels 132 is simply lowered by operating the swing handle to unwind the chains 28*b*, thereby allowing the upper scaffold portion 14 to be replaced on new upper ends of the four smoke funnels 132.

Specifically, the front end hooks 28*c* of the chain blocks 28 provided on the lower scaffold portions 18-2 and 18-4 are mounted to the inner walls of the two smoke funnels 132 on the diagonal line among the four smoke funnels 132, and the chain blocks 28 mounted to the two smoke funnels 132 among the four smoke funnels 132 can be used to perform the uneven scaffold supporting step and raising step, and the upper scaffold portion replacing step. Thus, there is no need to mount the chain blocks 28 to all of the four smoke funnels, thereby simplifying the steps, and increasing speed and efficiency of the smokestack demolishing work.

Further, in this embodiment, nothing is provided on the upper scaffold portion 14, but not limited to this. For example, as shown in FIG. 7, a small crane 34 may be provided in a center of the upper scaffold portion 14. The crane 34 is secured by, for example, bolts or the like inserted through the small holes 20 in the upper scaffold portion 14.

With this crane 34, the cut support steel tower 134 or the cut piece of the smoke funnel 132 can be moved and carried to the ground without manpower. This can increase speed and efficiency of the smokestack demolishing work.

Second Embodiment

Figure 8:
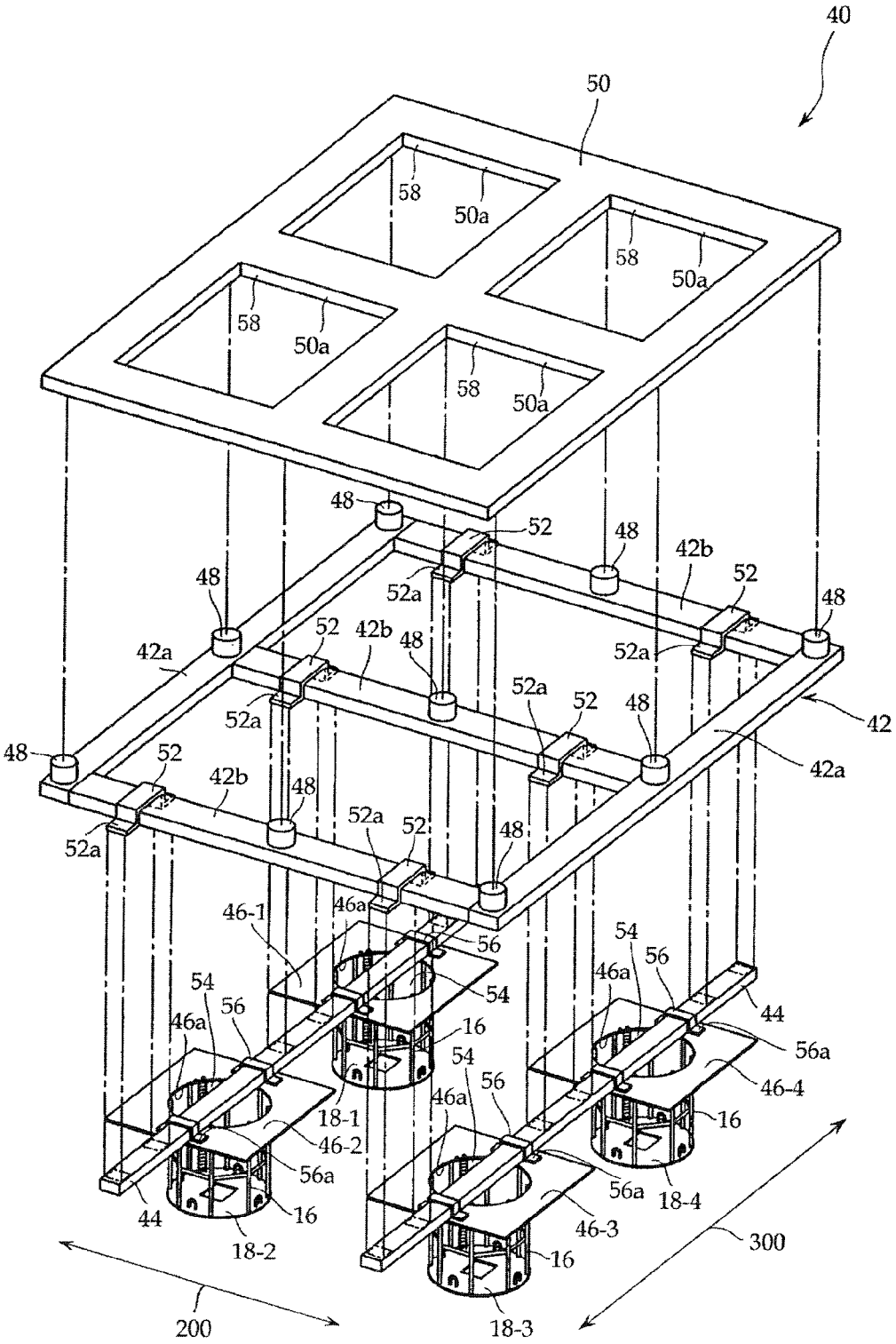
FIG. 8 is a schematic exploded perspective view of a smokestack demolishing scaffold apparatus 40 according to a second embodiment of the present invention.
Figure 9:
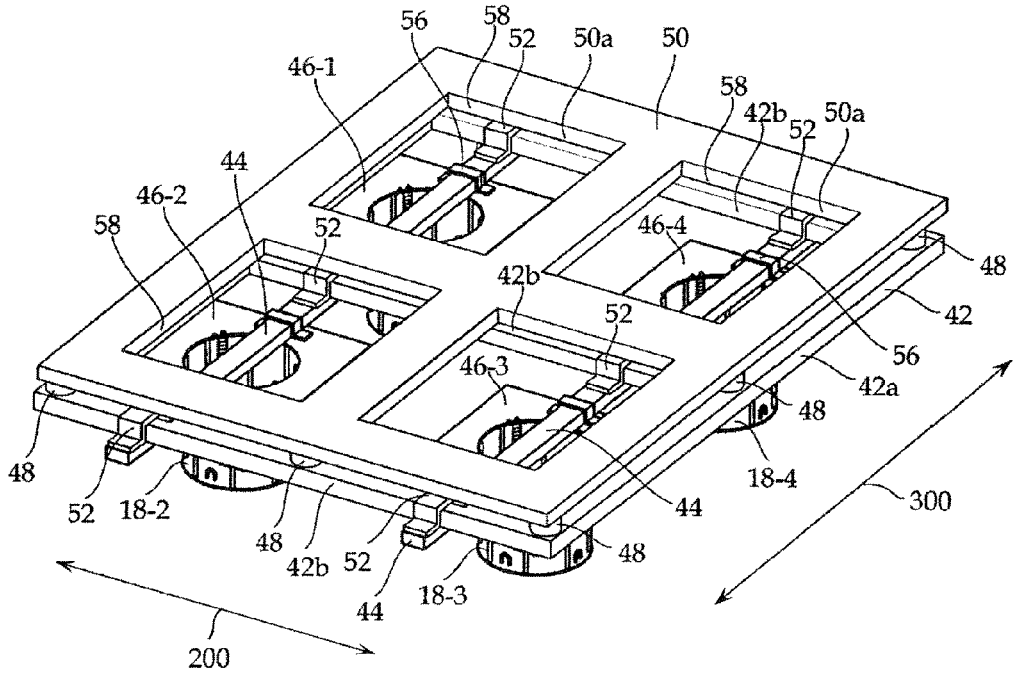
FIG. 9 is a schematic perspective view of the smokestack demolishing scaffold apparatus 40 according to the second embodiment of the present invention.
Figure 14:
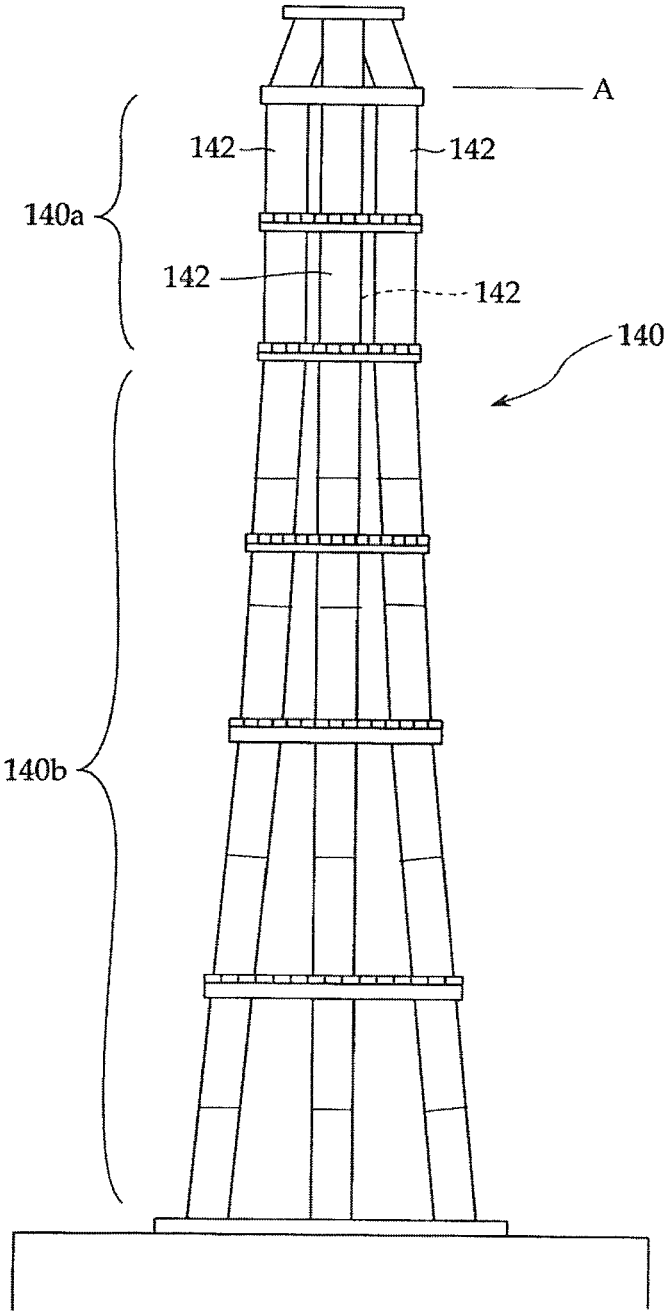
FIG. 14 illustrates a self-supported aggregate stack without a support steel tower.

With reference to FIGS. 8 and 9, a second embodiment of the present invention will be described when used for a four-legged aggregate stack 140 without a support steel tower, in which four smoke funnels 142 each having a single cylinder structure are collectively arranged, and combined to be flared from top to bottom and self-supported as shown in FIG. 14.

Specifically, the aggregate stack 140 is such that, as shown in FIG. 14, four smoke funnels 142 arranged to have a substantially rectangular shape on plan view include an upper region 140*a* extending substantially vertically, and a lower region 140*b* in which the four smoke funnels 142 are gradually radially spaced apart from each other from top to bottom below the upper region 140*a*.

FIG. 8 is a schematic exploded perspective view of a smokestack demolishing scaffold apparatus 40 according to a second embodiment of the present invention, FIG. 9 is a schematic perspective view of the smokestack demolishing scaffold apparatus 40 according to this embodiment, and FIG. 14 illustrates a self-supported aggregate stack 140 without a support steel tower. As shown in FIGS. 8 and 9, the smokestack demolishing scaffold apparatus 40 (the aggregate stack demolishing scaffold apparatus 40) according to this embodiment has a configuration in which a first beam member 42 includes three lateral beams 42*b* spanning two longitudinal beams 42*a* arranged adjacent to each other in parallel in a squarish figure of eight, and two second beam members 44 extending perpendicularly to the lateral beams 42*b* are suspended from and supported by the lateral beams 42*b* of the first beam member 42, and four plate-shaped upper scaffold portions 46 (46-1, 46-2, 46-3 and 46-4) to be placed on the respective smoke funnels 142 are suspended from and supported by the second beam members 44.

On the first beam member 42, a total of nine cylindrical table members 48 are provided at opposite ends and centers of the longitudinal beams 42*a* and centers of the lateral beams 42*b*, and a one plate-shaped auxiliary scaffold 50 is placed on the table member 48. The auxiliary scaffold 50 is a connecting scaffold when a worker moves between the upper scaffold portions 46 described later, and serves as a scaffold for demolishing a support steel tower together with the upper scaffold portions 46 when necessary.

On three locations: one end, the other end, and a center of the second beam member 44, hat-shaped section members 52 opening on a lower side each configure a closed section with the upper surface of the second beam member 44 with flange portions 52*a* joining the upper surface, and the lateral beam 42*b* is inserted through the closed section. Thus, the second beam member 44 is suspended from and supported by the lateral beam 42*b*, and the hat-shaped section member 52 is slidable between the longitudinal beam 42*a* and the table member 48 at the center of the lateral beam 42*b* in an extending direction of the lateral beam 42*b* (direction of arrow 200). Usually, to ensure safety in an aggregate stack demolishing work, a wedge member (not shown) is inserted between the hat-shaped section member 52 and the lateral beam 42*b* to prevent free sliding.

The upper scaffold portions 46 (46-1, 46-2, 46-3 and 46-4) are substantially rectangular plate members, and each has one through hole 54 at a center. As in the first embodiment, eight column members 16 are secured to a hole edge 46*a* of the through hole 54 in the upper scaffold portion 46. On an upper surface of the upper scaffold portion 46, two hat-shaped section members 56 opening on the lower side are arranged to span the through hole 54, flanges 56*a* thereof are joined near the through hole 54 to configure a closed section, and the second beam member 44 is inserted through the closed section.

Thus, the upper scaffold portion 46 is suspended from and supported by the second beam member 44, and slidable between the hat-shaped section members 52 in an extending direction of the second beam member 44 (direction of arrow 300). Specifically, the upper scaffold portion 46 is slidable in longitudinal and lateral directions (directions of arrows 200 and 300) with respect to the first beam member 42 via the second beam member 44. A wedge member (not shown) is also usually inserted between the hat-shaped section member 56 and the second beam member 44 to prevent free sliding.

The auxiliary scaffold 50 has four through holes 58. A position and a size of the through hole 58 are set so that a hole edge 50*a* thereof does not prevent a range in which the through hole 54 provided in the upper scaffold portion 46 are moved in longitudinal and lateral directions (directions of arrows 200 and 300) with respect to the first beam member 42 with movement of the auxiliary scaffold 50.

As described above, the uneven scaffold is separately configured as separate structures for the respective smoke funnels 142 by the four upper scaffold portions 46 (46-1, 46-2, 46-3 and 46-4) separately configured for the four smoke funnels 142, and each upper scaffold portion 46 is supported by the second beam member 44 among the first beam member 42 and the second beam member 44 that constitute the support, and thus each uneven scaffold is supported by the support.

If the worker needs to, for example, move from one lower scaffold portion 18-1 to another lower scaffold portion 18-2 to 18-4 on the upper scaffold portion 46 and the auxiliary scaffold 50 to demolish the support steel tower, the worker stands on the upper scaffold portion 46 and the auxiliary scaffold 50 to cut the support steel tower.

If the sliding of the upper scaffold portion 46 creates a clearance between the upper scaffold portion 46 and the auxiliary scaffold 50, a plate material 21 may be added to the auxiliary scaffold 50 to fill the clearance as in the first embodiment.

A method for demolishing an aggregate stack using the smokestack demolishing scaffold apparatus 40 according to this embodiment thus configured will be described below.

The method for demolishing the aggregate stack 140 using the smokestack demolishing scaffold apparatus 40 according to this embodiment includes an upper region demolishing work for demolishing an upper region 140*a* extending substantially vertically of the aggregate stack 140, and a lower region demolishing work for demolishing a lower region 140*b* in which the smoke funnels 142 are gradually radially spaced apart from each other below the upper region 140*a*.

First, the upper region demolishing work will be described. In the upper region demolishing work, first, as shown in FIG. 14, the four smoke funnels 142 are cut and removed by a predetermined method to a height A in FIG. 14. Then, when an upper end surface of the region 140*a* appears, materials are hoisted through the smoke funnels 142 by a winch or the like to assemble the smokestack demolishing scaffold apparatus 40 (that is, uneven scaffold) in the upper part of the smokestack. The uneven scaffolds of the assembled smokestack demolishing scaffold apparatus 40 are located together with the support (that is, the first beam member 42 and the second beam member 44) so that the lower scaffold portions 18 (18-1, 18-2, 18-3 and 18-4) are inserted into the smoke funnels 142 from the upper end surface of the region 140*a*, and the upper scaffold portions 46 (46-1, 46-2, 46-3 and 46-4) are placed on the upper ends of the smoke funnels 142 (an upper scaffold portion placing step).

Then, as in the first embodiment, a front end hook 28*c* of a chain block 28 is hung and mounted on a first shackle 33-1 previously mounted to an inner wall of the smoke funnel 142 above the U-shaped hook 30. Then, a swing handle (not shown) is operated to wind up a chain 28*b* to apply tension to the chain 28*b* to such an extent that the upper scaffold portion 46 is not spaced apart upward from the upper end of the smoke funnel 142. Thus, the uneven scaffold is supported on the inner walls of the two smoke funnels 142 filled with the lower scaffold portions 18-2 and 18-4 (an uneven scaffold supporting step). Then, as in the first embodiment, an uneven scaffold securing step may be performed as required.

Then, the swing handle of the chain block 28 is operated to further wind up the chain 28*b*, and thus the upper scaffold portion 46 is maintained at a height slightly apart upward from the upper end of each smoke funnel 142 (an uneven scaffold raising step).

This step may be also omitted. In this case, the following step is performed in a state where the upper scaffold portion 46 is placed on the upper end of each smoke funnel 142, tension is applied to the chain 28*b* to such an extent that the upper scaffold portion 46 is not spaced apart upward from the upper end of the smoke funnel 142, and the uneven scaffold is supported on the inner wall of the smoke funnel 142 by the chain block 28.

Specifically, the upper end of each smoke funnel 142 slightly apart from the upper scaffold portion 46 (the upper end of each smoke funnel 142 in contact with the upper scaffold portion 46 when the uneven scaffold raising step is omitted) is cut and removed from the upper end to a height near the mounting position of the shackle 33-1. Thus, a new upper end of the smoke funnel 142 is formed at a height lower than that before cutting. The smoke funnel 142 is cut by gas cutting by the worker, and the cut piece is dropped down into the smoke funnel 142 through the hole 18*a* (for example, see FIG. 5) (a smoke funnel cutting and removing step).

After the portion of the predetermined height of the smoke funnel 142 is cut and removed, the swing handle is operated to unwind the chain 28*b* to lower the uneven scaffold, and the upper scaffold portion 46 is replaced on the new upper end of each smoke funnel 142 (an upper scaffold portion replacing step).

Then, an uneven scaffold supporting step is performed of hanging and mounting the front end hook 28*c* on the second shackle 33-2 mounted to a part lower than the shackle 33-1 mounted to the inner wall of the smoke funnel 142 and a part at a height higher than the U-shaped hook 30 as a mounting part of the chain block 28 on the uneven scaffold, and then the steps up to the upper scaffold portion replacing step are repeated (a repeating step).

By the upper region demolishing work above, the upper region 140*a* in which the smoke funnels 142 substantially vertically stand is demolished.

Next, the lower region demolishing work will be described. When the aggregate stack 140 is demolished up to the lower end of the upper region 140*a*, the upper scaffold portion 46 is placed on the upper end of each smoke funnel 142 in the lower region 140*b*. In the lower region 140*b*, the smoke funnels 142 are gradually radially spaced apart from top to bottom, and thus a distance between the smoke funnels 142 is larger than a distance between the smoke funnels 142 in the upper region.

Thus, the separate structures constituting the uneven scaffold are horizontally moved apart (radially) from each other with increasing distance between the smoke funnels 142. Specifically, with the upper scaffold portion 46 being placed on the upper end of each smoke funnel 142, the wedge members inserted between the hat-shaped section member 52 and the lateral beam 42*b* and between the hat-shaped section member 56 and the second beam member 44 are removed, and the second beam member 44 is slid with respect to the lateral beam 42*b* (first beam member) and the upper scaffold portion 46 is slid with respect to the second beam member 44 so that the upper scaffold portions 46 are horizontally moved apart (radially) from each other. This sliding adjusts the distance between the lower scaffold portions 18 so as to match the increased distance between the smoke funnels 142.

After the adjustment, the wedge members are again inserted between the hat-shaped section member 52 and the lateral beam 42*b* (first beam member) and between the hat-shaped section member 56 and the second beam member 44 to prevent free sliding thereof (the uneven scaffold as the separate structures horizontally moving step).

Then, the mounting part of the front end hook 28*c* to the inner wall of each of the two smoke funnels 142 is changed to a shackle 33-*n*+1 mounted to a part lower than a shackle 33-*n* as an original mounting part and at a height higher than the U-shaped hook 30 as the mounting part of the chain hook 28 on the uneven scaffold. Then, the suspending length of the chain 28*b* of the chain block 28 is adjusted by the swing handle to apply tension to such an extent that the upper scaffold portion 46 is not spaced apart upward from the upper end of each smoke funnel 142 (an uneven scaffold as the separate structures re-supporting step).

Then, as in the first embodiment, the uneven scaffold securing step and the uneven scaffold raising step may be performed as required.

Then, the upper end of each smoke funnel 142 is cut and removed from the upper end of each smoke funnel 142 to a height near the mounting position of the shackle 33-*n*+1. Thus, a new upper end of the smoke funnel 142 is formed at a height lower than that before cutting (a smoke funnel cutting and removing step).

After the portion of the predetermined height of the smoke funnel 142 is cut and removed, the swing handle is operated to unwind the chain 28*b* to lower the uneven scaffold joined to the inner wall of each of the two smoke funnels, and thus all the upper scaffold portions 46 are replaced on the new upper ends of the smoke funnels 142 (an upper scaffold portion replacing step).

Then, the steps from the uneven scaffold as the separate structures horizontally moving step to the upper scaffold portion replacing step are repeated (a repeating step).

By the lower region demolishing work above, the lower region 140*b* is demolished in which the smoke funnels 142 are gradually spaced apart from each other from top to bottom.

Thus, with the smokestack demolishing scaffold apparatus 40 according to this embodiment, the upper scaffold portions 46 are simultaneously vertically movable together with the support (the first beam member 42 and the second beam member 44). This provides a scaffold apparatus with improved safety in which there is no possibility that the upper scaffold portions 46 separately vertically moved come into contact with each other, and thus the demolishing work can be safely advanced without vibration due to the contact.

The four separate structures constituting the uneven scaffold are movably supported by the support (the first beam member 42 and the second beam member 44), and thus can be horizontally moved in longitudinal, lateral, and oblique directions from the original position. Thus, even for the "flared" self-supported aggregate stack 140 having the lower region 140*b* in which the distance between the smoke funnels 142 gradually increases from top to bottom, the separate structures constituting the uneven scaffold can be horizontally moved in the directions gradually apart from each other, and the demolishing work of the aggregate stack 140 can be advanced by matching the distance between the lower scaffold portions with the distance between the smoke funnels 142.

Also, by the method for demolishing the aggregate stack 140 using the smokestack demolishing scaffold apparatus 40 according to this embodiment, the chain blocks 28 join the inner walls of the two smoke funnels 142 among the four smoke funnels 142 with the uneven scaffolds to adjust the length of the chains 28*b*, thereby finishing the uneven scaffold supporting step. Also, only the chain blocks 28 mounted to the two smoke funnels 142 are operated to also finish the upper scaffold portion replacing step. This significantly increases speed and efficiency of the smokestack demolishing work, which is further economical.

Thus, for example, a relatively high-level part (for example, a part higher than 50 m) of a four-legged self-supported aggregate stack 140 can be demolished using the smokestack demolishing scaffold apparatus 40 without building a temporary scaffold, and a low-level region is demolished by a conventional method such as building a temporary scaffold from a middle stage as required, thereby allowing the aggregate stack 140 to be easily demolished at low cost.

Further, this embodiment has the configuration in which the upper scaffold portion 46 is suspended from and supported by the second beam member 44, and the second beam member 44 is suspended from and supported by the first beam member 42 (lateral beam 42*b*) as an example, but not limited to this, different variants may be applied.

Figure 10:
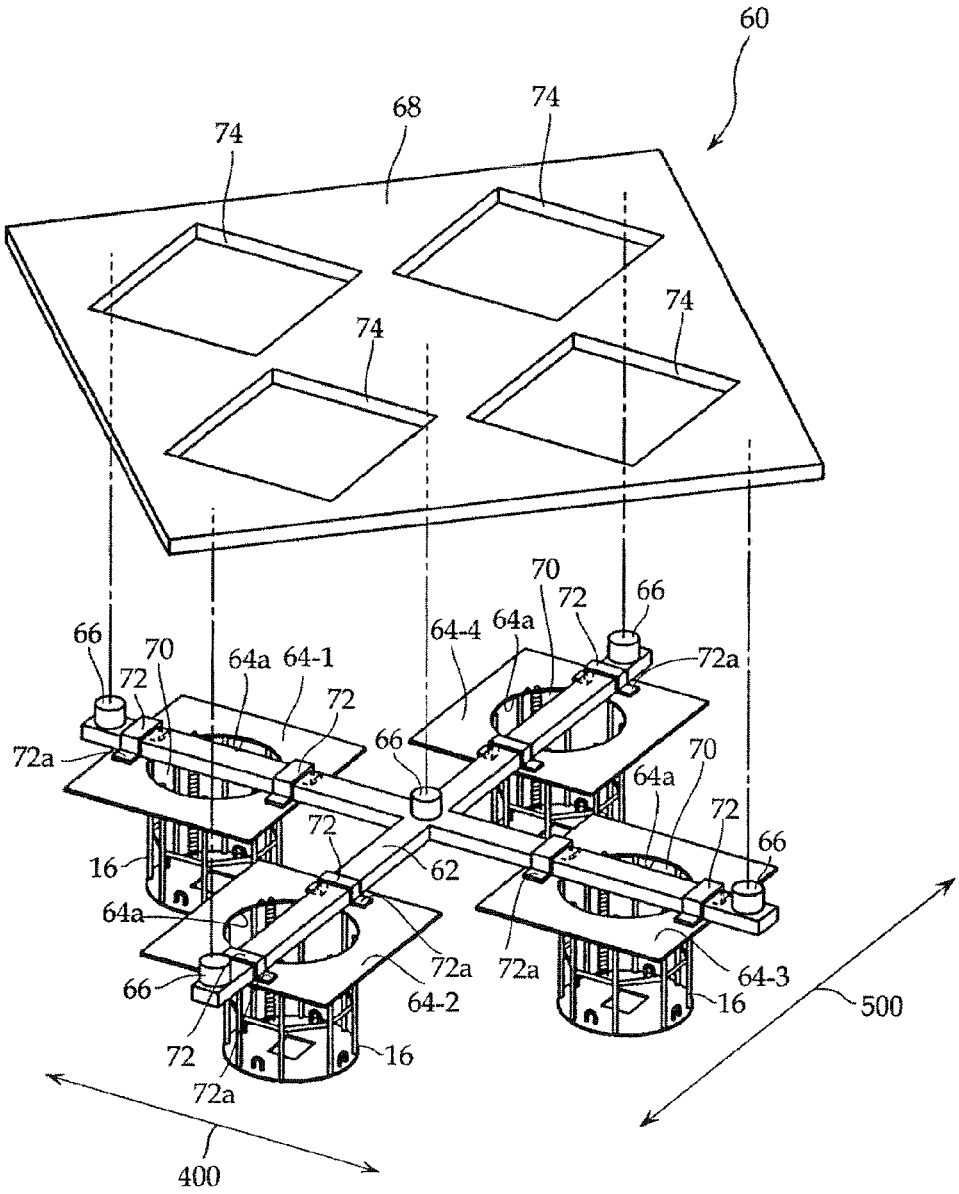
FIG. 10 is a schematic exploded perspective view of a variant of the smokestack demolishing scaffold apparatus 40 according to the second embodiment of the present invention.
Figure 11:
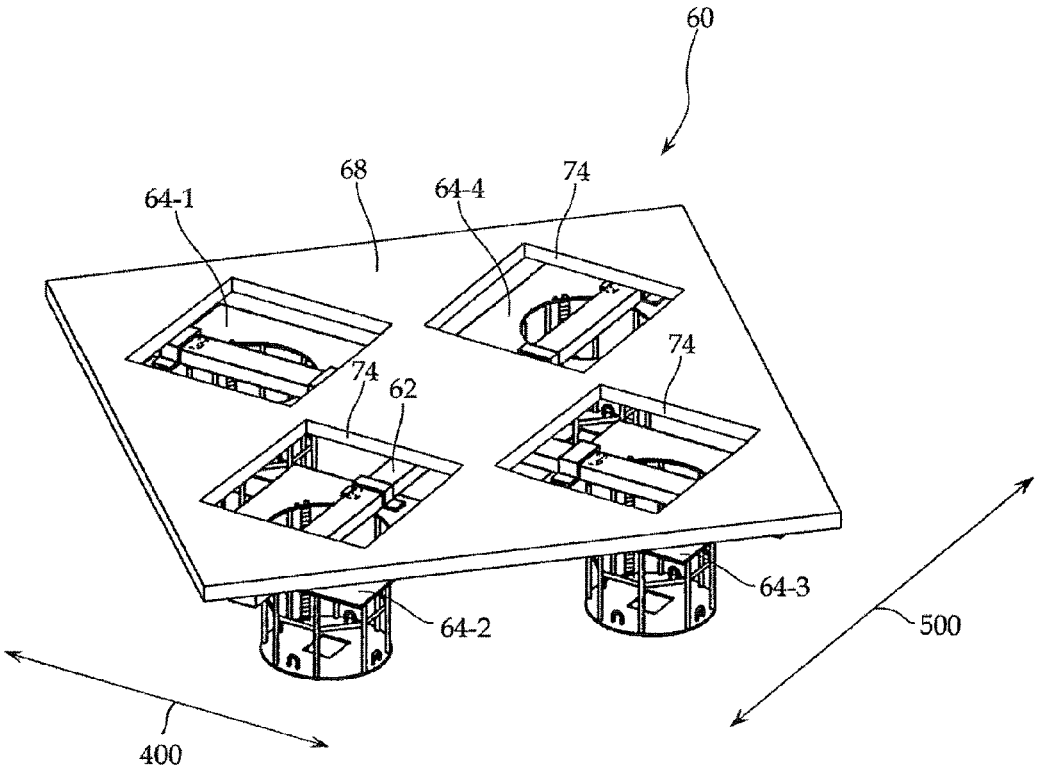
FIG. 11 is a schematic perspective view of a variant of the smokestack demolishing scaffold apparatus 40 according to the second embodiment of the present invention.
Figure 12:
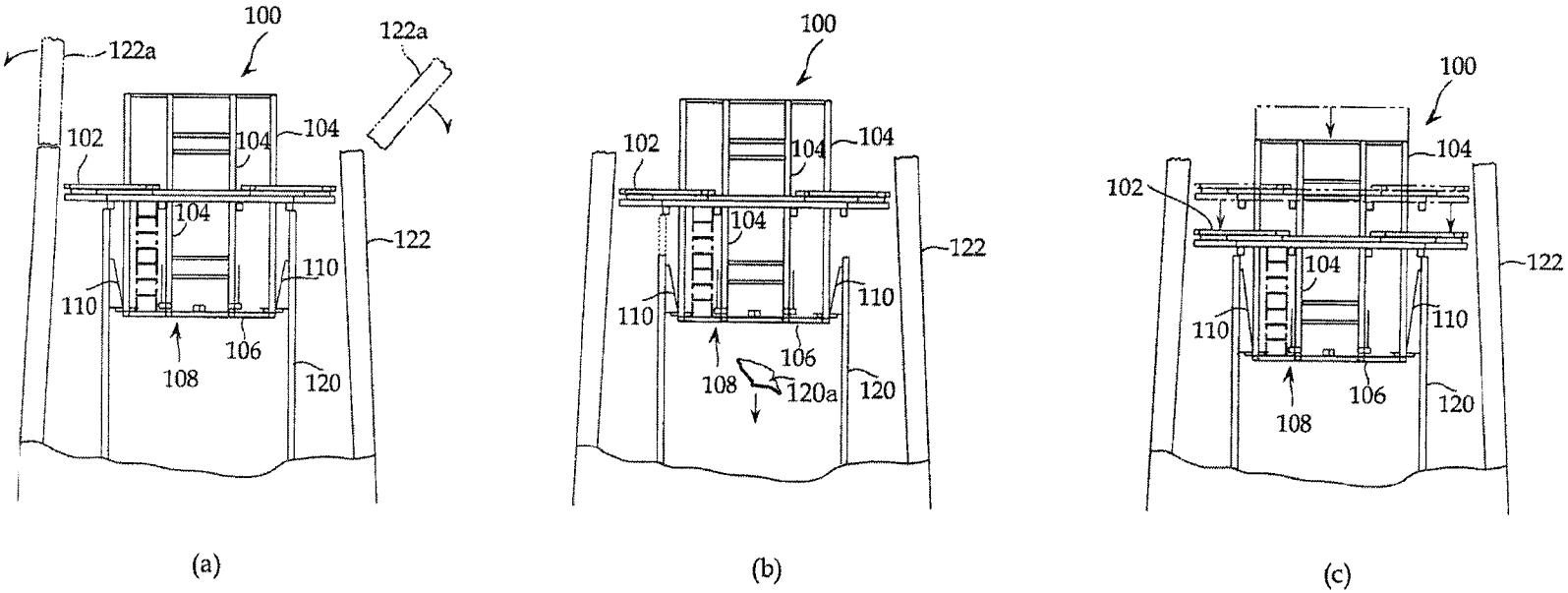
Fig. 12 Prior Art
FIG. 12 illustrates demolishing of a smokestack using a conventional smokestack demolishing scaffold apparatus.

With reference to FIGS. 10 and 11, the variants will be described when used for a four-legged aggregate stack 140 without a support steel tower, in which four smoke funnels 142 each having a single cylinder structure are collectively arranged, and combined to be flared from top to bottom and self-supported as shown in FIG. 14 as in the second embodiment. In FIGS. 10 and 11, like components as in the second embodiment in FIGS. 8 and 9 and the first embodiment in FIGS. 1 to 7 are denoted by like reference numerals, and descriptions thereof will be omitted.

FIG. 10 is a schematic exploded perspective view of a variant of a smokestack demolishing scaffold apparatus 40 according to this embodiment, and FIG. 11 is a schematic perspective view of a variant of the smokestack demolishing scaffold apparatus 40 according to this embodiment. As shown, in a smokestack demolishing scaffold apparatus 60 (that is, an aggregate stack demolishing scaffold apparatus 60) according to the variant, (total of four) upper scaffold portions 64 are suspended and supported between a center and four ends of a substantially cross-shaped beam member 62, and a one plate-shaped auxiliary scaffold 68 is placed on table members 66 provided at five locations: the center and the four ends.

The upper scaffold portions 64 (64-1, 64-2, 64-3 and 64-4) are substantially rectangular plate members, and each has one through hole 70 at a center. As in the first and second embodiments, eight column members 16 are secured to a hole edge 64*a* of the through hole 70 in the upper scaffold portion 64. On an upper surface of the upper scaffold portion 64, two hat-shaped section members 72 opening on a lower side are arranged to span the through hole 70, flanges 72*a* thereof are joined near the through hole 70 to configure a closed section, and the beam member 62 is inserted through the closed section.

Thus, the upper scaffold portion 64 is slidable between the center and the ends of the beam member 62 in an extending direction of the beam member 62 (direction of arrow 400 or 500).

In the auxiliary scaffold 68, four through holes 74 having a size that does not block the through holes 70 are provided correspondingly to positions of the through holes 70 in a range of movement of the through holes 70 with sliding of the upper scaffold portions 64 with respect to the beam member 62.

With the smokestack demolishing scaffold apparatus 60, when the smokestack demolishing scaffold apparatus 60 is used to demolish the self-supported aggregate stack 140, a distance between the smoke funnels 142 increases diagonally (radially) from top to bottom, and a distance between the lower scaffold portions 18 is increased in the directions apart from each other, thereby allowing the distance between the lower scaffold portions 18 to be matched with the distance between the smoke funnels 142.

The present invention is not limited to the above embodiments, but may be changed without departing from the gist of the invention. For example, in this embodiment, the smokestack assemblies 130 and 140 in which the four smoke funnels are collectively arranged as one unit has been described as an example, but an aggregate stack demolishing scaffold apparatus for demolishing an aggregate stack in which two, three, five or more smoke funnels are collectively arranged may be provided. In this case, the number of lower scaffold portions can be increased correspondingly to the number of smoke funnels to accommodate such an aggregate stack.

Also, the bolt 26 and the chain block 28 used for securing the lower scaffold portion 18 are not limited to them, but various methods may be applied.

REFERENCE SIGNS LIST

10, 40, 60 smokestack demolishing scaffold apparatus (aggregate stack demolishing scaffold apparatus)
14, 46, 64 upper scaffold portion
18 lower scaffold portion
28 chain block (suspending means)
42 first beam member (support)
44 second beam member (support)
62 beam member (support)

The invention claimed is:

1. A method for demolishing an aggregate stack in which a plurality of smoke funnels substantially vertically stand using an aggregate stack demolishing scaffold apparatus including an uneven scaffold including at least one upper scaffold portion that can be placed on upper ends of the smoke funnels, and configured to be simultaneously vertically movable, and lower scaffold portions coupled to the upper scaffold portion, and configured to be located in lower positions in the smoke funnels with the upper scaffold portion being placed on the upper ends of the smoke funnels, and suspending means capable of joining a part lower than the upper scaffold portion in the uneven scaffold with an inner wall of each smoke funnel to suspend and support the uneven scaffold from and on the inner wall, and adjusting a suspending height, where the upper scaffold portion is spaced apart from the upper ends of the smoke funnels, wherein the uneven scaffold is an integral-type scaffold coupled by one upper scaffold portion integrally formed, wherein the method comprises:

an upper scaffold portion placing step of lowering the uneven scaffold from an upper part of the aggregate stack to insert the lower scaffold portion into each smoke funnel, and place the upper scaffold portion to span an upper end of each smoke funnel;

an uneven scaffold supporting step of joining a part lower than the upper scaffold portion in the uneven scaffold with an inner wall of at least one smoke funnel among the plurality of smoke funnels at a height higher than the lower part using the suspending means, and adjusting a suspending length of the suspending means to apply tension to such an extent that the upper scaffold portion remains without being spaced apart from the upper end of each smoke funnel;

a smoke funnel cutting and removing step of cutting and removing each smoke funnel from the upper end of each smoke funnel to a height nearer to a mounting position of the suspending means to the inner wall of the smoke funnel;

an upper scaffold portion replacing step of lowering the uneven scaffold using the suspending means, and placing the upper scaffold portion on a new upper end of each smoke funnel; and a repeating step of repeating from the uneven scaffold supporting step to the upper scaffold portion replacing step.

2. A method for demolishing an aggregate stack including an upper region in which a plurality of smoke funnels substantially vertically stand, and a lower region in which the plurality of smoke funnels are gradually spaced apart from each other from top to bottom below the upper region using an aggregate stack demolishing scaffold apparatus including an uneven scaffold including at least one upper scaffold portion that can be placed on upper ends of the smoke funnels, and configured to be simultaneously vertically movable, and lower scaffold portions coupled to the upper scaffold portion, and configured to be located in lower positions in the smoke funnels with the upper scaffold portion being placed on the upper ends of the smoke funnels, and suspending means capable of joining a part lower than the upper scaffold portion in the uneven scaffold with an inner wall of each smoke funnel to suspend and support the uneven scaffold from and on the inner wall, and adjusting a suspending height, where the upper scaffold portion is spaced apart from the upper ends of the smoke funnels, wherein the uneven scaffold is separately configured as separate structures, each of which corresponding to one of the smoke funnels to be demolished, and mounted to a support located above the separate structures, and the separate structures are mounted to the support so as to be horizontally movable apart from each other, wherein the method comprises:

an upper region demolishing work including an upper scaffold portion placing step of lowering the uneven scaffold, which is configured as separate structures, together with a support from an upper part of the aggregate stack, inserting a lower scaffold portion into each smoke funnel, and placing a respective upper scaffold portion on an upper end of each smoke funnel, an uneven scaffold supporting step of joining a part lower than the upper scaffold portion in the uneven scaffold with an inner wall of at least one smoke funnel among the plurality of smoke funnels at a height higher than the lower part using the suspending means, and adjusting a suspending length of the suspending means to apply tension to such an extent that the upper scaffold portion remains without being spaced apart upward from the upper end of each smoke funnel, a smoke funnel cutting and removing step of cutting and removing each smoke funnel from the upper end of each smoke funnel to a height nearer to a mounting part of the suspending means to the inner wall of the smoke funnel, an upper scaffold portion replacing step of lowering the uneven scaffold joined to the inner wall of the at least one smoke funnel using the suspending means, and placing all the upper scaffold portions on new upper ends of the smoke funnels, and a repeating step of repeating from the uneven scaffold supporting step to the upper scaffold portion replacing step up to a lower end of the upper region; and a lower region demolishing work including a moving step of horizontally moving the separate structures apart from each other in accordance with an increased distance between the smoke funnels, and matching a distance between the lower scaffold portions inserted into the smoke funnels with the increased distance between the smoke funnels, with the upper scaffold portion being placed on the upper end of each smoke funnel in the lower region after the upper region demolishing work is finished, a re-supporting step of changing a mounting part of the suspending means to an inner wall of the at least one smoke funnel to a part lower than an original mounting part and at a height higher than the mounting part of the suspending means to the uneven scaffold, and adjusting a suspending length of the suspending means to apply tension to such an extent that the upper scaffold portion is not spaced apart upward from the upper end of each smokestack, a smoke funnel cutting and removing step of cutting and removing each smoke funnel from the upper end of each smoke funnel to a height nearer to the mounting part of the suspending means to the inner wall of the smoke funnel, an upper scaffold portion replacing step of lowering the uneven scaffold joined to the inner wall of the at least one smoke funnel using the suspending means, and placing all the upper scaffold portions on new upper ends of the smoke funnels; and a repeating step of repeating from the uneven scaffold horizontally moving step to the upper scaffold portion replacing step.

3. A method for demolishing an aggregate stack including an upper region in which a plurality of smoke funnels substantially vertically stand, and a lower region in which the plurality of smoke funnels are gradually spaced apart from each other from top to bottom below the upper region using an aggregate stack demolishing scaffold apparatus including an uneven scaffold including at least one upper scaffold portion that can be placed on upper ends of the smoke funnels, and configured to be simultaneously vertically movable, and lower scaffold portions coupled to the upper scaffold portion, and configured to be located in lower positions in the smoke funnels with the upper scaffold portion being placed on the upper ends of the smoke funnels, and suspending means capable of joining a part lower than the upper scaffold portion in the uneven scaffold with an inner wall of each smoke funnel to suspend and support the uneven scaffold from and on the inner wall, and adjusting a suspending height, where the upper scaffold portion is spaced apart from the upper ends of the smoke funnels, wherein the uneven scaffold is separately configured as separate structures, each of which corresponding to one of the smoke funnels to be demolished, and mounted to a support located above the separate structures, and the separate structures are mounted to the support so as to be horizontally movable apart from each other, and wherein the support includes a first beam member extending in one direction, and a second beam member extending perpendicularly to the first beam member, and supported by the first beam member so as to be movable in an extending direction of the first beam member, and the structures constituting the uneven scaffold are mounted to the second beam member so as to be movable in an extending direction of the second beam member, wherein the method comprises:

an upper region demolishing work including an upper scaffold portion placing step of lowering the uneven scaffold, which configured as separate structures, together with a support from an upper part of the aggregate stack, inserting a lower scaffold portion into each smoke funnel, and placing a respective upper scaffold portion on an upper end of each smoke funnel, an uneven scaffold supporting step of joining a part lower than the upper scaffold portion in the uneven scaffold with an inner wall of at least one smoke funnel among the plurality of smoke funnels at a height higher than the lower part using the suspending means, and adjusting a suspending length of the suspending means to apply tension to such an extent that the upper scaffold portion remains without being spaced apart upward from the upper end of each smoke funnel, a smoke funnel cutting and removing step of cutting and removing each smoke funnel from the upper end of each smoke funnel to a height nearer to a mounting part of the suspending means to the inner wall of the smoke funnel, an upper scaffold portion replacing step of lowering the uneven scaffold joined to the inner wall of the at least one smoke funnel using the suspending means, and placing all the upper scaffold portions on new upper ends of the smoke funnels, and a repeating step of repeating from the uneven scaffold supporting step to the upper scaffold portion replacing step up to a lower end of the upper region; and a lower region demolishing work including a moving step of horizontally moving the separate structures apart from each other in accordance with an increased distance between the smoke funnels, and matching a distance between the lower scaffold portions, inserted into the smoke funnels with the increased distance between the smoke funnels, with the upper scaffold portion being placed on the upper end of each smoke funnel in the lower region after the upper region demolishing work is finished, a re-supporting step of changing a mounting part of the suspending means to an inner wall of the at least one smoke funnel to a part lower than an original mounting part and at a height higher than the mounting part of the suspending means to the uneven scaffold, and adjusting a suspending length of the suspending means to apply tension to such an extent that the upper scaffold portion is not spaced apart upward from the upper end of each smokestack, a smoke funnel cutting and removing step of cutting and removing each smoke funnel from the upper end of each smoke funnel to a height nearer to the mounting part of the suspending means to the inner wall of the smoke funnel, an upper scaffold portion replacing step of lowering the uneven scaffold joined to the inner wall of the at least one smoke funnel using the suspending means, and placing all the upper scaffold portions on new upper ends of the smoke funnels; and a repeating step of repeating from the uneven scaffold horizontally moving step to the upper scaffold portion replacing step.

4. A method for demolishing an aggregate stack including an upper region in which a plurality of smoke funnels substantially vertically stand, and a lower region in which the plurality of smoke funnels are gradually spaced apart from each other from top to bottom below the upper region using an aggregate stack demolishing scaffold apparatus including an uneven scaffold including at least one upper scaffold portion that can be placed on upper ends of the smoke funnels, and configured to be simultaneously vertically movable, and lower scaffold portions coupled to the upper scaffold portion, and configured to be located in lower positions in the smoke funnels with the upper scaffold portion being placed on the upper ends of the smoke funnels, and suspending means capable of joining a part lower than the upper scaffold portion in the uneven scaffold with an inner wall of each smoke funnel to suspend and support the uneven scaffold from and on the inner wall, and adjusting a suspending height, where the upper scaffold portion is spaced apart from the upper ends of the smoke funnels, wherein the uneven scaffold is separately configured as separate structures, each of which corresponding to one of the smoke funnels to be demolished, and mounted to a support located above the separate structures, and the separate structures are mounted to the support so as to be horizontally movable apart from each other, and wherein the support is a substantially cross-shaped beam member, and the separate structures are mounted between a center and four ends of the beam member so as to be reciprocable between the center and the ends of the beam member, wherein the method comprises:

an upper region demolishing work including an upper scaffold portion placing step of lowering the uneven scaffold, which configured as separate structures, together with a support from an upper part of the aggregate stack, inserting a lower scaffold portion into each smoke funnel, and placing a respective upper scaffold portion on an upper end of each smoke funnel, an uneven scaffold supporting step of joining a part lower than the upper scaffold portion in the uneven scaffold with an inner wall of at least one smoke funnel among the plurality of smoke funnels at a height higher than the lower part using the suspending means, and adjusting a suspending length of the suspending means to apply tension to such an extent that the upper scaffold portion remains without being spaced apart upward from the upper end of each smoke funnel, a smoke funnel cutting and removing step of cutting and removing each smoke funnel from the upper end of each smoke funnel to a height nearer to a mounting part of the suspending means to the inner wall of the smoke funnel, an upper scaffold portion replacing step of lowering the uneven scaffold joined to the inner wall of the at least one smoke funnel using the suspending means, and placing all the upper scaffold portions on new upper ends of the smoke funnels, and a repeating step of repeating from the uneven scaffold supporting step to the upper scaffold portion replacing step up to a lower end of the upper region; and a lower region demolishing work including a moving step of horizontally moving the separate structures apart from each other in accordance with an increased distance between the smoke funnels, and matching a distance between the lower scaffold portions inserted into the smoke funnels with the increased distance between the smoke funnels, with the upper scaffold portion being placed on the upper end of each smoke funnel in the lower region after the upper region demolishing work is finished, a re-supporting step of changing a mounting part of the suspending means to an inner wall of the at least one smoke funnel to a part lower than an original mounting part and at a height higher than the mounting part of the suspending means to the uneven scaffold, and adjusting a suspending length of the suspending means to apply tension to such an extent that the upper scaffold portion is not spaced apart upward from the upper end of each smokestack, a smoke funnel cutting and removing step of cutting and removing each smoke funnel from the upper end of each smoke funnel to a height nearer to the mounting part of the suspending means to the inner wall of the smoke funnel, an upper scaffold portion replacing step of lowering the uneven scaffold joined to the inner wall of the at least one smoke funnel using the suspending means, and placing all the upper scaffold portions on new upper ends of the smoke funnels; and a repeating step of repeating from the uneven scaffold horizontally moving step to the upper scaffold portion replacing step.

* * * * *